US012721405B2

(12) United States Patent
Bidal et al.

(10) Patent No.: US 12,721,405 B2
(45) **Date of Patent: *Sep. 1, 2026**

(54) GOLF SHOES WITH LACE TIGHTENING SYSTEM FOR CLOSURE AND COMFORTABLE FIT

(71) Applicant: Acushnet Company, Fairhaven, MA (US)

(72) Inventors: Jean-Marie Bidal, Marlborough, MA (US); Paul O. Teeter, Pembroke, MA (US)

(73) Assignee: Acushnet Company, Fairhaven, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/809,419

(22) Filed: Aug. 20, 2024

(65) Prior Publication Data

US 2024/0407503 A1 Dec. 12, 2024

Related U.S. Application Data

(63) Continuation of application No. 17/365,077, filed on Jul. 1, 2021, now Pat. No. 12,114,733, which is a continuation-in-part of application No. 17/355,390, filed on Jun. 23, 2021, now Pat. No. 12,167,777.

(60) Provisional application No. 63/051,070, filed on Jul. 13, 2020.

(51) Int. Cl.

| | |
|---|---|
| ***A43C 1/00*** | (2006.01) |
| ***A43B 5/00*** | (2022.01) |
| ***A43C 1/06*** | (2006.01) |
| *A43B 23/02* | (2006.01) |
| *A43C 1/04* | (2006.01) |
| *A43C 9/00* | (2006.01) |
| *A43C 11/00* | (2006.01) |

(52) U.S. Cl.

CPC ..... *A43C 1/06* (2013.01); *A43B 5/001* (2013.01); *A43B 23/0245* (2013.01); *A43C 1/04* (2013.01); *A43C 9/00* (2013.01); *A43C 11/004* (2013.01)

(58) Field of Classification Search

CPC .. A43C 1/04; A43C 1/06; A43C 1/003; A43C 9/11; A43C 11/00; A43B 5/001

See application file for complete search history.

(56) References Cited

U.S. PATENT DOCUMENTS

| | | | |
|---|---|---|---|
| 5,341,583 | A | 8/1994 | Hallenbeck |
| 5,511,325 | A | 4/1996 | Hieblinger |
| 5,692,319 | A | 12/1997 | Parker et al. |
| 5,692,320 | A | 12/1997 | Nichols |
| 7,343,701 | B2 | 3/2008 | Pare et al. |
| 8,869,435 | B2 | 10/2014 | Hatfield et al. |
| 8,991,074 | B2 | 3/2015 | Ivester et al. |
| 9,375,052 | B2 | 6/2016 | Krueger |
| 9,462,851 | B2 | 10/2016 | Baker et al. |
| 9,491,983 | B2 | 11/2016 | Rushbrook |
| 10,299,540 | B2 | 5/2019 | Bishop et al. |
| 10,299,541 | B2 | 5/2019 | Bishop et al. |
| 2002/0095750 | A1 | 7/2002 | Hammerslag |
| 2003/0204938 | A1 | 11/2003 | Hammerslag |

(Continued)

*Primary Examiner* — Katharine G Kane

(57) ABSTRACT

The present disclosure generally relates to golf shoes having a lace tightening system. The shoe may include one or more lace guides configured to receive a lace. The lace may be threaded through the lace guides and tightened or loosened using an adjustment mechanism mounted on the shoe. The lace and the lace tightening system may be used to secure a power shroud around a subject's foot.

18 Claims, 26 Drawing Sheets

(56) References Cited

U.S. PATENT DOCUMENTS

| | | | |
|---|---|---|---|
| 2005/0022427 | A1 | 2/2005 | Kerns |
| 2005/0198866 | A1 | 9/2005 | Wiper |
| 2008/0110048 | A1 | 5/2008 | Dua et al. |
| 2015/0089839 | A1 | 4/2015 | James |
| 2015/0289595 | A1 | 10/2015 | Rushbrook |
| 2016/0044994 | A1 | 2/2016 | Soderberg |
| 2017/0027287 | A1 | 2/2017 | Burns |
| 2017/0215524 | A1 | 8/2017 | Rushbrook |
| 2018/0160764 | A1 | 6/2018 | Garneau |
| 2018/0352898 | A1 | 12/2018 | Onoda |
| 2020/0229543 | A1 | 7/2020 | Houng et al. |
| 2021/0093046 | A1 | 4/2021 | Lam et al. |
| 2021/0112922 | A1 | 4/2021 | Bock |

GOLF SHOES WITH LACE TIGHTENING SYSTEM FOR CLOSURE AND COMFORTABLE FIT

CROSS-REFERENCE

This application is a continuation application of U.S. patent application Ser. No. 17/365,077 filed Jul. 1, 2021, which application is a continuation-in-part application of U.S. patent application Ser. No. 17/355,390 filed Jun. 23, 2021, which claims the benefit of U.S. Provisional Patent Application No. 63/051,070 filed Jul. 13, 2020, the entire disclosures of which are incorporated by reference herein.

BACKGROUND

Field of the Invention

The present invention relates generally to shoes and more particularly to golf shoes having a lace tightening system. The upper of the shoe includes various lace guides that are separated by gaps. The lace is threaded through these guides and the lace can be tightened or loosened by a rotary dial mounted on the shoe. The lace tightening system can be used to close the instep region around the foot to secure the shoe and provide a comfortable fit. The midsole provides cushioning to the shoe. The outsole preferably contains multiple traction members to provide good stability and ground contact.

Brief Review of the Related Art

Both professional and amateur golfers use specially designed golf shoes today. Typically, the golf shoe includes an upper portion and outsole portion along with a mid-sole connecting the upper to the outsole. The upper has a traditional shape for inserting a user's foot and thus covers and protects the foot in the shoe. The upper is designed to provide a comfortable fit around the contour of the foot. The mid-sole is relatively lightweight and provides cushioning to the shoe. The outsole is designed to provide stability and traction for the golfer. The bottom surface of the outsole may include spikes or cleats designed to engage the ground surface through contact with and penetration of the ground. These elements help provide the golfer with better foot stability and traction as he/she walks and plays the course.

Golf shoe manufacturers have developed shoes with an upper containing an instep region with a typical lace-tying system. The laces are used to control the size of the opening of the throat opening in the instep region for inserting the foot. In such conventional shoes, the laces are threaded through a series of eyelets on opposing sides of the shoe upper. The laces are threaded through the eyelets in a zig-zag pattern overlying the tongue of the shoe. When the golfer inserts his/her foot into the instep and pulls on the lace to "tie the shoe", the eyelets are pulled together and instep region is closed.

In recent years, athletic shoe manufacturers have developed lace tightening systems that do not use conventional laces as described in the patent literature. For example, Hieblinger, U.S. Pat. No. 5,511,325 discloses an athletic shoe having a central rotary closure arranged on the heel of the upper and at least one tightening element which has a tightening section running from the central rotary closure towards each side of the shoe. The tightening sections are coupled by a coupling element with at least one strap which runs from each tightening section or coupling element over the instep or/and by the arch to the other tightening section or coupling element.

Krueger, U.S. Pat. No. 9,375,052 discloses a sport shoe having a sole connected with an upper shoe part that has two adjacent arranged tensioning sections in its instep region which are separated by a gap. A lacing system is arranged so the shoe can be laced at the foot of the wearer by pulling the tensioning sections against another. The lacing system includes a rotary central closure system mounted on the tongue of the shoe. According to the Krueger '052 Patent, running shoes can be made with this lacing system. For golf applications, the Krueger '052 Patent, discloses that the right and the left shoe can be designed differently with respect to the run of the tensioning elements.

Baker et al., U.S. Pat. No. 9,462,851 discloses a shoe having a cable disposed between an upper and a sole plate. The upper includes a flexible main body and an exoskeleton covering a portion of the flexible main body in an instep region. The cable is attached to the exoskeleton so that the exoskeleton is tightened to a wearer's foot when the cable tension is increased. According to the Baker '851 Patent, the cable tensioning system is particularly suitable for turf shoes such as soccer and football cleats. The Baker '851 Patent also discloses running shoes, tennis shoes, cross-training shoes, walking shoes, and hiking boots.

Rushbrook, U.S. Pat. No. 9,491,983 discloses a shoe having a sole structure with a gap extending longitudinally through the sole structure. A tensioning member extends through the sole structure and across the gap such that tensioning the tensioning member contracts the gap and pulls opposing sides of the sole structure together. As the sole structure contracts, the upper is pulled down on the foot, thereby tightening the upper around the foot. The Rushbrook '983 Patent discloses suitable footwear as including hiking boots, soccer shoes, football shoes, sneakers, running shoes, cross-training shoes, rugby shoes, basketball shoes, and baseball shoes.

There is still a need for an improved golf shoe having a lace tightening system that can be used to close the instep region around the contour of the foot and provide a comfortable fit. The lace tightening system should be able to secure the foot in the shoe, while also providing a comfortable and smooth fit. Also, the lace tightening system should be comfortable for all golfers. Some golfers prefer a tight and snug fit with their shoes. These golfers want a shoe that very closely fits the contour of their foot. Other golfers prefer a looser fit so the foot can move more easily in the shoe. In both instances, the golfer wants a stable shoe that also has a comfortable and smooth fit. The shoe should hold and support the medial and lateral sides and heel region of the golfer's foot as they shift their weight while making a golf shot. The shoe should provide good stability so there is no slipping and the golfer can stay balanced as he/she swings the club.

Also, one drawback with some conventional golf shoes is these shoes may help provide the golfer with good stability and traction, but there is a loss in shoe flexibility. Some traditional golf shoes are relatively stiff-they provide a rigid platform, but they do not provide the needed flexibility for golfers. As discussed further below, when a golfer swings a club and transfers his/her weight on their feet, there are high forces placed on the foot. The shoe needs to provide a stable platform for the golfer when he/she maker their swing, but the foot also needs to be able to flex to a certain degree. The golfer needs their foot to feel comfortable in the shoe.

The shoes of this invention have a distinctive upper construction with a lace tightening system that helps to hold and support the golfer's foot in the shoe. The shoes have a closure system that securely keeps the foot in the shoe and helps provide the golfer with a stable platform. At the same time, the closure system provides the golfer with a comfortable fit. The shoe is easy and natural to wear. The shoes provide high structural support and traction for the golfer, and yet they also are easy and natural to wear. The shoes allow the foot to flex and move as needed. The shoes provide stability and power without sacrificing comfort, flexibility, and other golf-performance properties.

SUMMARY

The present invention provides golf shoes having different lace tightening systems. The golf shoe comprises an upper, an outsole, and a midsole connected to the upper and outsole, wherein the upper, midsole, and outsole each have forefoot, mid-foot, and rear-foot regions and lateral and medial sides. The shoe further comprises a lace tightening system, wherein the tightening system comprises a lace and lace tightening assembly. In one embodiment, the upper further comprises an instep region for allowing a foot to be inserted into the upper, the instep region having a tongue member; a power shroud overlying the tongue member; and a lower chip extending upwardly along the lateral side of the upper. There is also a first upper lace guide; a second upper lace guide; a first lower lace guide; and a second lower lace guide. The first and second upper lace guides are attached to the power shroud and the first and second lower lace guides are attached to the lower chip. The upper further includes a lateral lace channel extending from the rear-foot region along the lateral side of the upper for receiving the lace. The lace passes outwardly from the channel, preferably through an eyelet guide, and through the lace guides such that the lace forms a loop between the power shroud and lower chip. Thus, when the lace is tightened, the power shroud is pulled towards the lower chip and the shoe is tightened around the foot.

In one pathway, the lace can pass from the lateral lace channel to the first upper lace guide and then downwardly to the second lower lace guide; and then upwardly to the second upper lace guide and then downwardly to the first lower lace guide. Then, the lace can pass from the first lower lace guide to a termination plate attached to the power shroud. In one example, the lace crosses over itself in two criss-crossing zones as it passes from the lace channel to the termination plate.

In one example, the lace tightening assembly comprises a rotary dial that is pushed inwardly to engage the assembly; rotated in a clockwise direction to tighten the lace, and rotated in a counter-clockwise direction to loosen the lace. The lace tightening assembly can further comprise a spool for winding and unwinding the lace and a locking mechanism for locking the lace in place. In one example, the dial can be pulled outwardly to release the locking mechanism. The lace tightening assembly can be mounted on the rear-foot (heel) region or in other regions of the upper. The lace is preferably made of a metal or fiber material. Also, the lace guides can be made of a fiber material and attached to the power shroud and lower chip by stitching or other suitable fastening means. The upper and lower lace guides are substantially parallel to each other oriented at angles so that when the lace is tightened, an angled downward force is applied to the power shroud.

In another embodiment, the upper comprises an instep region for allowing a foot to be inserted into the upper, the instep region having a tongue member; a power shroud overlying the tongue member; and a lower chip extending upwardly along the lateral side of the upper. The upper further comprises a first upper lace guide; a second upper lace guide; a third upper lace guide; a first lower lace guide; and a second lower lace guide. The first and second upper lace guides are attached to a side edge of the power shroud and the third upper lace guide is attached to an upper edge of the power shroud. The first and second lower lace guides are attached to the lower chip.

The lateral lace channel extends from the rear-foot region along the lateral side of the upper and a medial lace channel extends from the rear-foot region along the medial side of the upper. The channels are adapted for receiving the lace, wherein the lace passes outwardly from the lateral channel and through the upper and lower lace guides and through the third upper lace guide and into the medial channel. Thus, the lace forms a continuous loop so that the lace extends along the lateral and medial sides and around the heel region of the upper. When the lace is tightened, the power shroud is pulled towards the lower chip and the shoe is tightened around the foot. In one pathway, the lace passes from the lateral lace channel to the first upper lace guide and then downwardly to the second lower lace guide; and then upwardly to the second upper lace guide and then downwardly to the first lower lace guide and then upwardly to the third upper lace guide and then into the medial lace channel. In one example, the lace crosses over itself in two criss-crossing zones.

In yet another embodiment, the upper comprises an instep region for allowing a foot to be inserted into the upper, the instep region having a tongue member; a power shroud overlying the tongue member; and a lower chip extending upwardly along the lateral side of the upper. Three also is a first upper lace guide; a second upper lace guide; a third upper lace guide; a first lower lace guide; and a second lower lace guide. The first and second upper lace guides are attached to a side edge of the power shroud and the third upper lace guide is attached to an upper edge of the power shroud. The first and second lower lace guides are attached to the lower chip.

The upper further comprises a lateral lace channel extending from the rear-foot region along the lateral side of the upper and a medial lace channel extending from the rear-foot region along the medial side of the upper. The channels are adapted for receiving the lace, wherein the lace passes outwardly from the lateral channel and through the upper and lower lace guides and through the third upper lace guide and into the medial channel. The lace thus forms a continuous loop so that the lace extends along the lateral and medial sides and around the heel region of the upper. When the lace is tightened, the power shroud is pulled towards the lower chip and the shoe is tightened around the foot.

In one example, there is a skeletal frame overlying the upper, the frame comprising a plurality of rib members extending upwardly from the midsole, and wherein the ribs are joined together to define an aperture and forming an A-Frame shaped structure. Skeletal frame extends over the lateral and medial sides of the upper to form A-Frame shaped structures on the lateral and medial sides of the upper. The skeletal frame is preferably made of a thermoplastic polyurethane (TPU) material.

In still another embodiment, the shoe includes a first lace tightening system, the first tightening system comprising a first lace and first lace tightening assembly; and a second lace tightening system, the second tightening system comprising a second lace and second lace tightening assembly. The upper comprises an instep region for allowing a foot to be inserted into the upper, the instep region having a tongue member; a first power shroud extending from the medial side of the upper and overlying the tongue member; and a second power shroud extending from the lateral side of the upper and overlying the tongue member. There is also a first upper lace guide; a second upper lace guide; and a first lower lace guide. The first upper lace guide is attached to the first power shroud and the second upper lace guide is attached to the second power shroud, and the first lower lace guide being attached to the medial side of the upper.

The first lace extends from the first lace tightening system and passes through the first upper lace guide so that when the first lace is tightened, the first power shroud is pulled towards the lateral side of the upper. Meanwhile, the second lace extends from the second lace tightening system and passes through the second upper lace guide and through the first lower lace guide so that when the lace is tightened, the second power shroud is pulled towards the medial side of the upper. In this way, the shoe is tightened around the foot.

In one example, the first lace tightening assembly is mounted on the lateral side of the upper and the second lace tightening assembly is mounted on the rear-foot (heel) region of the upper. Both lace tightening assemblies can comprise rotary dials, and these dials can be pushed inwardly to engage the tightening assemblies. The dials can be rotated in a clockwise direction to tighten the first and second laces, and rotated in a counter-clockwise direction to loosen the first and second laces. The tightening assemblies can comprise spools for winding and unwinding the laces and locking mechanisms for locking the first and second laces in place. In one example, the dials can be pulled outwardly to release the locking mechanisms. In one example, the upper further comprises a lace channel extending from the rear-foot region along the lateral side of the upper for receiving the second lace, the second lace passing outwardly from the channel and passing through the second upper lace guide attached to the second power shroud.

BRIEF DESCRIPTION OF THE FIGURES

The novel features that are characteristic of the present invention are set forth in the appended claims. However, the preferred embodiments of the invention, together with further objects and attendant advantages, are best understood by reference to the following detailed description in connection with the accompanying drawings in which:

DETAILED DESCRIPTION

Figure 1:
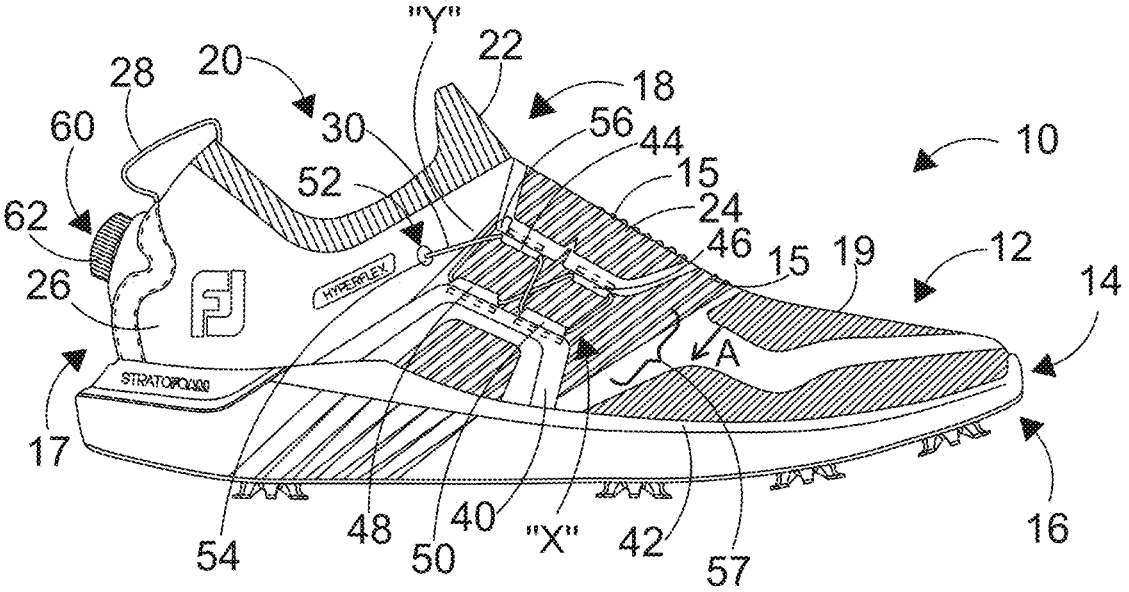
FIG. 1 is a lateral side view of one example of a golf shoe of the present invention showing the upper portion in detail.

Referring to the Figures, where like reference numerals are used to designate like elements, and particularly FIG. 1, one embodiment of the golf shoe (10) of this invention is shown. The shoe (10) includes an upper portion (12) and outsole portion (16) along with a midsole (14) connecting the upper (12) to the outsole (16). The views shown in the Figures are of a right shoe and it is understood the components for a left shoe will be mirror images of the right shoe. It also should be understood that the shoe may be made in various sizes and thus the size of the components of the shoe may be adjusted depending upon the shoe size.

Construction

Figure 2:
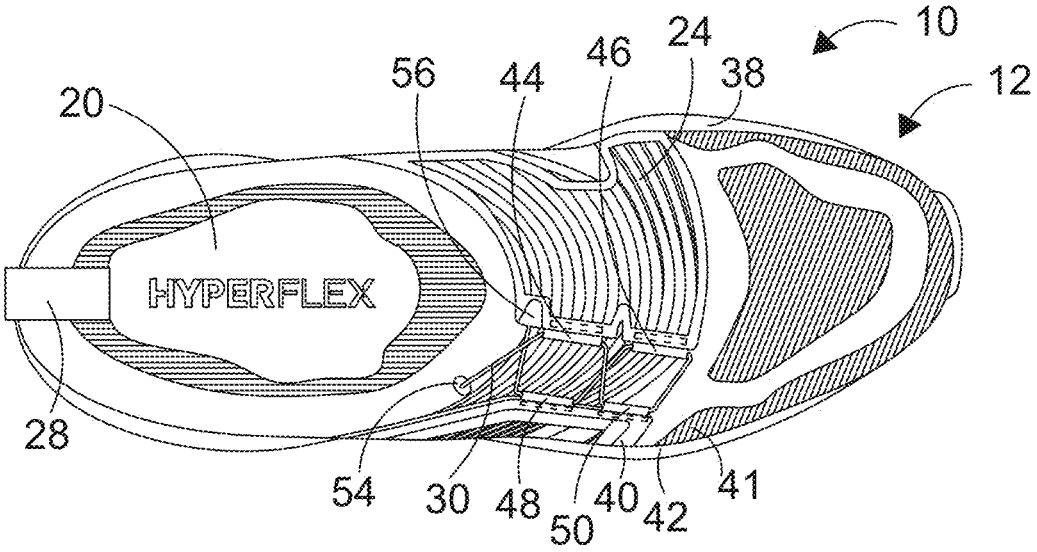
FIG. 2 is a top plan view of the golf shoe shown in FIG. 1.
Figure 3:
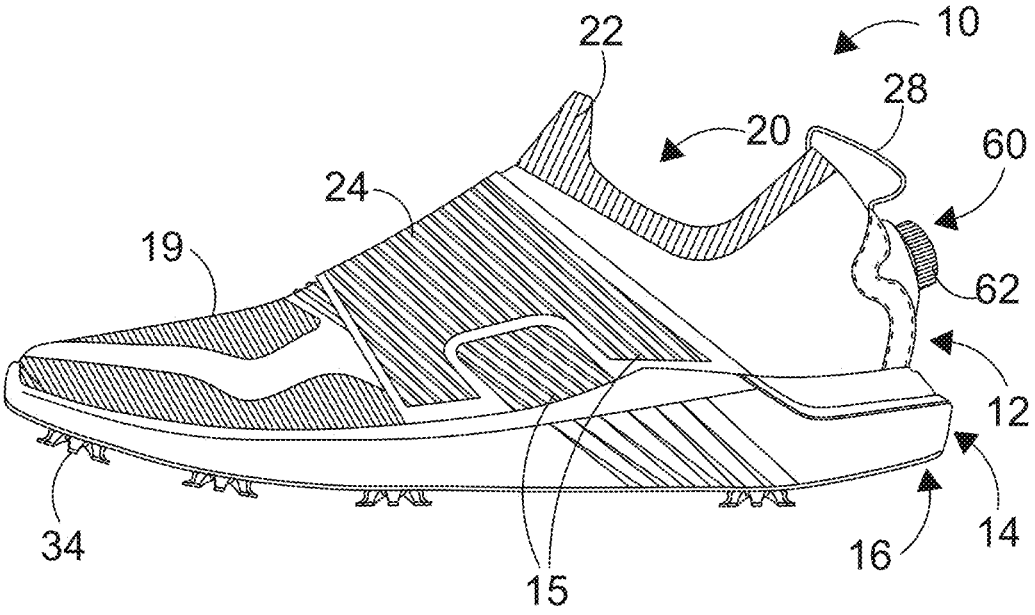
FIG. 3 is a medial side view of the golf shoe shown in FIG. 1.

The upper (12) has a traditional shape and is made from a standard upper material such as, for example, natural leather, synthetic leather, knits, non-woven materials, natural fabrics, and synthetic fabrics. For example, breathable, mesh, and synthetic textile fabrics made from nylons, polyesters, polyolefins, polyurethanes, rubbers, foams, and combinations thereof can be used. The material used to construct the upper is selected based on desired properties such as breathability, durability, flexibility, and comfort. In one preferred example, the upper (12) is made of a mesh material. The upper material is stitched or bonded together to form an upper structure. Referring to FIGS. 1-3, the upper (12) generally includes an instep region (18) with a throat opening (20) for inserting a foot. The upper includes a vamp (19) for covering the forepart of the foot and a tongue member (22). The instep region includes a power shroud or shield (24) overlying the tongue member (22). The upper (12) may include a foxing (26) and optional ghille strip (28) extending from the rear area of the instep region (18). Laces (30) are used for tightening the shoe around the contour of the foot. Different lace tightening systems for tightening and locking the lace in place and loosening the lace (30) are discussed further below. It should be understood that the above-described upper (12) shown in FIGS. 1-3 represents only one example of an upper that can be used in the shoe constructions of this invention and other uppers can be used without departing from the spirit and scope of this invention.

The midsole (14) is relatively lightweight and provides cushioning to the shoe. The midsole (14) can be made from a standard midsole material such as, for example, foamed ethylene vinyl acetate copolymer (EVA) or polyurethane. In one manufacturing process, the midsole (14) is molded on and about the outsole. Alternatively, the midsole (14) can be molded as a separate piece and then joined to the top surface (not shown) of the outsole (16) by stitching, adhesives, or other suitable fastening means using standard techniques known in the art. For example, the midsole (14) can be heat-pressed and bonded to the top surface of the outsole (16). It should be understood that the above-described midsole (14) shown in FIGS. 1-3 represents only one example of a midsole that can be used in the shoe constructions of this invention and other midsoles can be used without departing from the spirit and scope of this invention.

Figure 4:
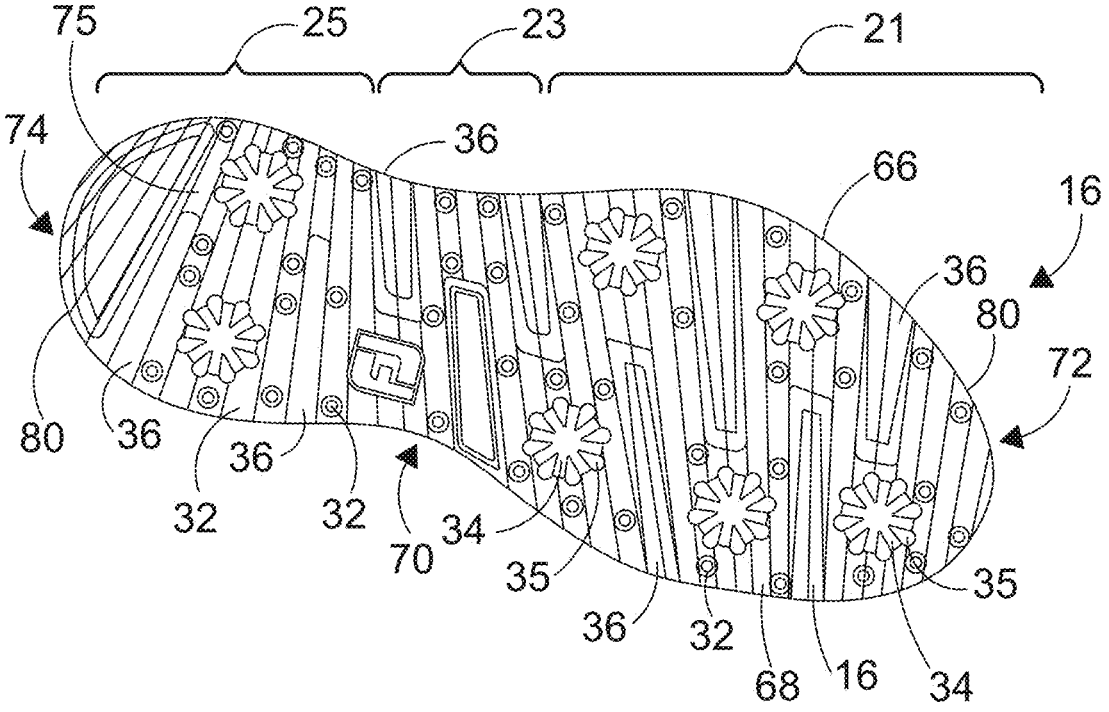
FIG. 4 is a bottom plan view of the golf shoe shown in FIG. 1 showing the outsole portion in detail.
Figure 5:
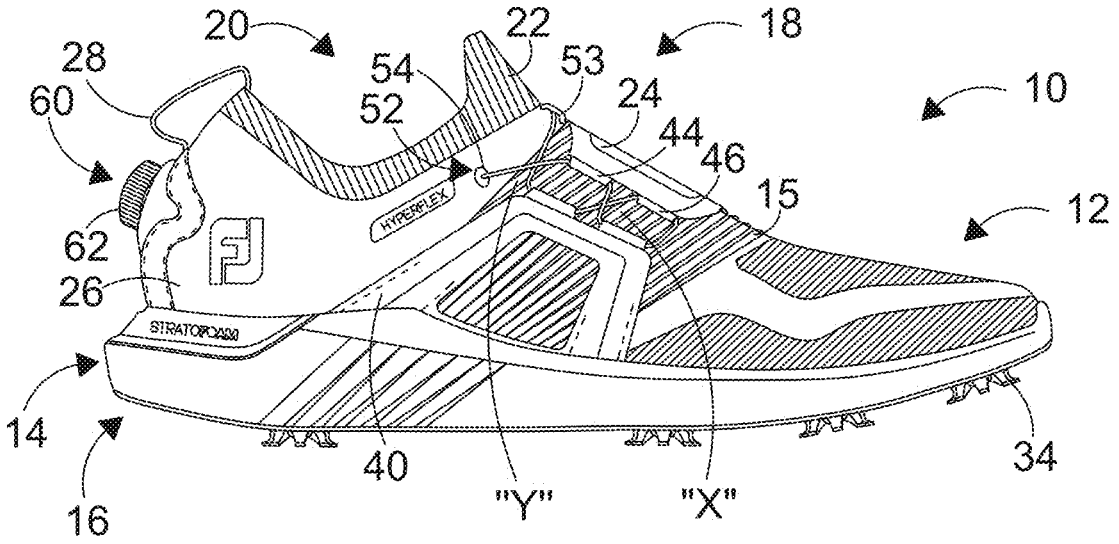
FIG. 5 is a lateral side view of a second example of a golf shoe of the present invention showing the upper portion in detail.
Figure 6:
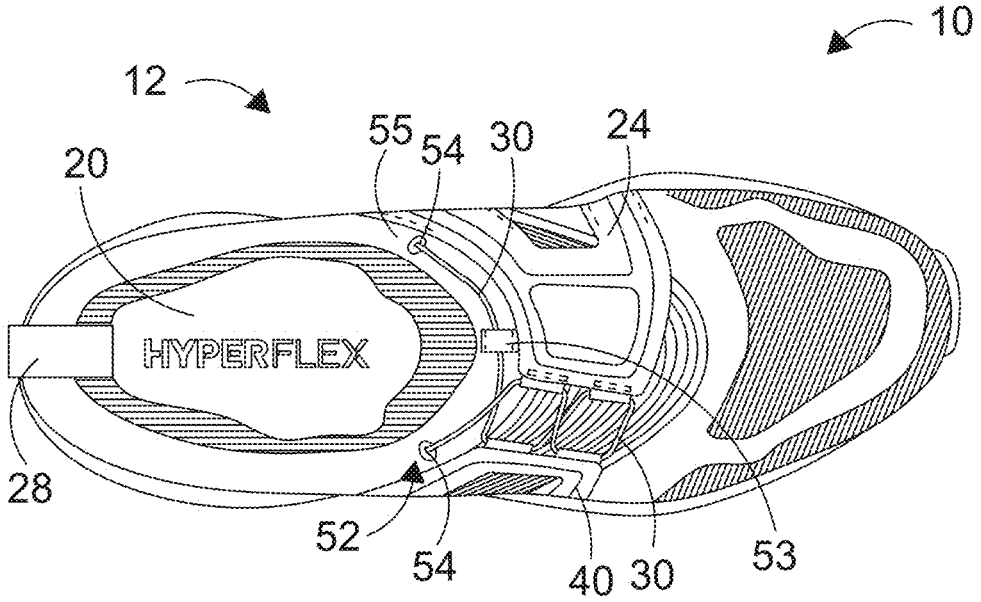
FIG. 6 is a top plan view of the golf shoe shown in FIG. 5.
Figure 7:
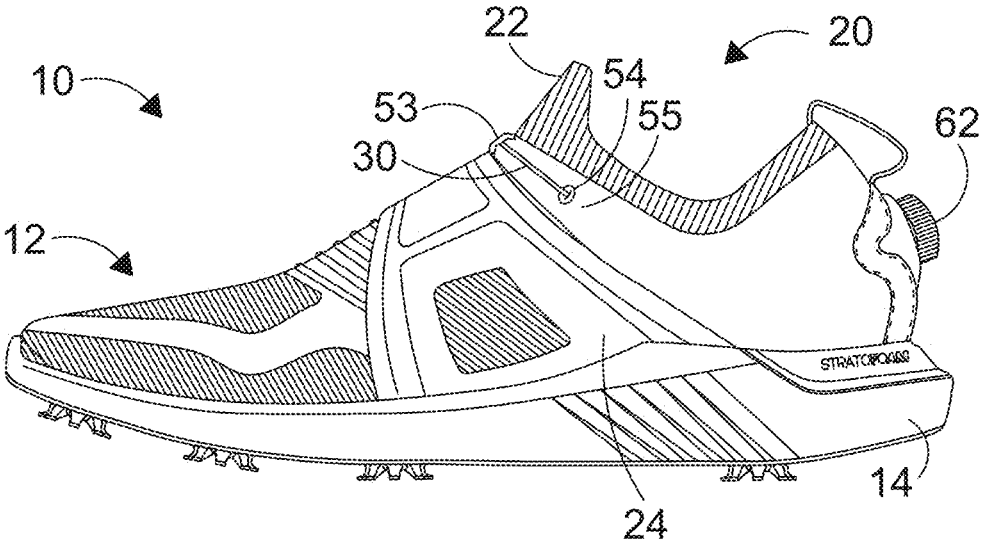
FIG. 7 is a medial side view of the golf shoe shown in FIG. 5.
Figure 8:
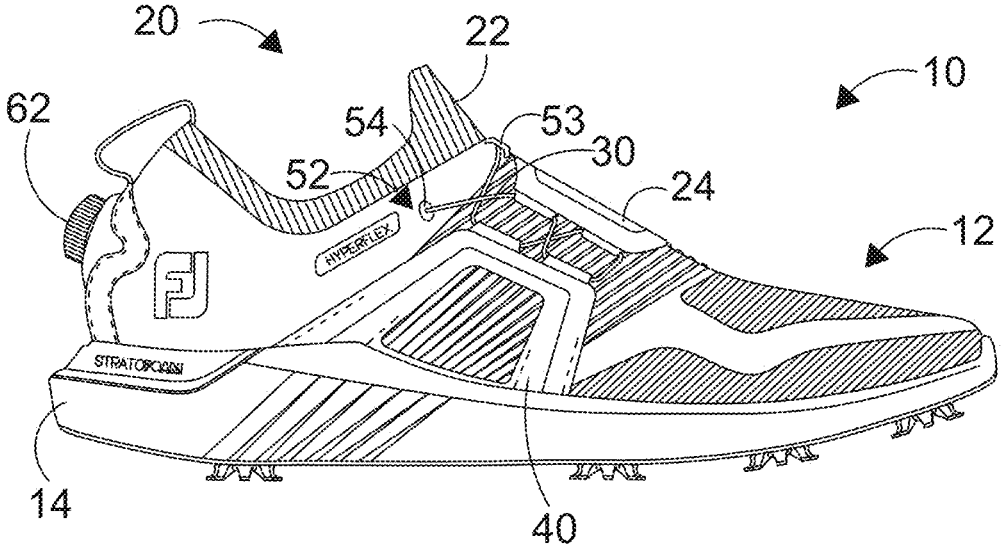
FIG. 8 is a second lateral side view of the golf shoe shown in FIG. 5.

In general, the outsole (16) is designed to provide stability and traction for the shoe. Referring to FIG. 4, the bottom surface of the outsole (16) includes multiple traction members (32) to help provide traction between the shoe and grass on the course. The bottom surface of the outsole (16) and traction members (32) can be made of any suitable material such as rubber or plastics and combinations thereof. Thermoplastics such as nylons, polyesters, polyolefins, and polyurethanes can be used.

The bottom surface of the outsole (16) is configured to contact the ground during golf play. The golf shoe preferably includes traction projections of various shapes that protrude from the bottom surface of the outsole. The traction projections or members (32) can be of various shapes and sizes. The traction members (32) may be of any suitable shape including, but not limited to, rectangular, triangular, square, spherical, star, diamond, pyramid, arrow, rod, or conical-shapes. Also, the height and area of the traction members (32) may be the same or different. The traction members (32) are designed to engage the ground surface and provide an increased area of contact with the ground. This helps provide the golfer with better foot traction on the turf as he/she walks the course and plays the round. It should be understood that the above-described outsole (16) shown in FIG. 4 represents only one example of an outsole that can be used in the shoe constructions of this invention and other outsole designs can be used without departing from the spirit and scope of this invention.

As further shown in FIG. 4, the bottom surface of the outsole (16) may further include spikes or cleats (34). The attached cleats provide additional traction between the shoe and ground surface. If such spikes or cleats (34) are present, they are preferably releasably fastened to sockets (receptacles) (35) in the outsole (16). The outsole (16) may further include flex channels (36) that extend transversely along the outsole. The structure and functionality of the outsole (16) shown in FIG. 4 is described in further detail below.

Basically, the anatomy of the foot can be divided into three bony regions. The rear-foot region generally includes the ankle (talus) and heel (calcaneus) bones. The mid-foot region includes the cuboid, cuneiform, and navicular bones that form the longitudinal arch of the foot. The forefoot region includes the metatarsals and the toes. The outsole (16) includes a metatarsal (forefoot) portion (21) positioned generally under a wearer's metatarsal bones, an arch (mid-foot) portion (23) positioned generally under a wearer's foot arch, and a calcaneus (rear-foot) portion (25) positioned generally under a wearer's calcaneus bone. The outsole (16) has a top (upper) surface (not shown) and bottom (lower) surface (27). The midsole (14) is joined to the top surface of the outsole (16).

Upper

Referring back to FIG. 1, the upper portion (12) generally includes an instep region (18) with a throat opening (20) for inserting a foot. The instep region (18) includes a tongue member (22), and a power shroud (24) that extends from medial edge or side (38) of the upper and overlies the tongue member (22). The power shroud (24) is pulled over the instep region (18) and towards the lateral side (41) when the lace (30) is tightened via the lace tightening system (60) as described further below. The lower chip (40) extends upwardly from the lateral edge (42) of the upper (12). As shown in FIGS. 2-3, in this example, the power shroud (24) has a Y-shaped structure. It is recognized, however, that the power shroud (24) and lower chip (40) can be of other suitable shapes. In FIGS. 1-3, the upper (12) is made of an engineered mesh material with ribs (13), and the power shroud (24) also contains matching ribs (15) to provide an upper (12) having aesthetically pleasant lines and a fashionable design. The lower chip (40) can be made of any suitable material, for example, thermoplastic polyurethane (TPU). The power shroud (24) also includes: i) a first upper lace guide (44), and ii) a second upper lace guide (46). The lower chip (40) also includes a first lower lace guide (48), and a second lower lace guide (50).

The upper (12) further includes a lateral lace channel (52) extending along the lateral side of the upper. The lace (30) is disposed in the channel (52) so that it extends from the lace tightening assembly (60) in the heel region (17) to the instep region (18). The lace (30) can be made of any material known in the art, such as, for example, metals, fibers, and the like. For example, the lace (30) can be made of a yarn, cord, rope, string, fibers, filaments, strands, fabrics, webbing or other textile material. Polyamides (nylons), aramids such as Kevlar™ fibers, polyesters, polyurethanes, polypropylenes, polyethylenes, and the like can be used to make the lace (30). In other embodiments, the lace (30) can be made from metal, glass, carbon fiber, carbon fiber composites, or a metal material such as a metal wire or cable and the like. Stainless steel laces (30) can be used. Preferably, the lace (30) is made of an abrasion-resistant, durable material. Combinations of materials also can be used. For example, the lace (30) can me made of stainless steel, nylons, polyesters, polyurethanes, polypropylenes, and/or polyethylenes. Other materials that can be used to make the lace (30) include Dyneema™ composite fabric which is a laminated fabric constructed from ultra-high molecular weight polyethylene (UHMWPE) fiber. Monofilaments, fibers, and films can also be used to form the laces (30).

The lace (30) extends through the eyelet guide (54) and to the heel region (17), where the lace tightening assembly (60) is preferably mounted. As the lace (30) is tightened, the power shroud (24) is pulled downwardly so that it at least partially covers the instep region (18). Preferably, as the power shroud (24) is tightened, it covers the entire instep region (18). In this way, the shoe (10) is fitted securely and comfortably around the foot. The tightening of the lace (30) as it is pulled through the lace guides and the forces applied to the power shroud (24) and shoe (10) are described further below.

Lace Guides

As shown in FIGS. 1-2, the first upper lace guide (44), which is attached to the power shroud (24) is oriented in an angled position. The first upper lace guide (44) can be attached to the power shroud (24) by stitching, adhesives, or any other suitable fastening means. The lace (30) extends from a lace tightening assembly (60) in the heel region (discussed further below) and exits a trumpet or eyelet guide (54). The lace (30) then enters the first upper lace guide (44) at an entrance point and exits the lace guide (44) at an exit point. Thus, the lace guide (44) helps direct the pathway of the lace (30) around the shoe upper.

After the lace (30) exits the first upper lace guide (44) at the exit point, it passes downwardly and enters the second lower lace guide (50) at an entrance point. The lace travels through the second lower lace guide (50) and then exits the lace guide (50) at an exit point. After exiting the second lower lace guide (50), the lace is threaded upwardly to the second upper lace guide (46), where it enters the guide (46) at an entrance point. Then, the lace (30) travels through the second upper lace guide (46) and exits the lace guide (46) at an exit point. The lace (30) then passes downwardly and crosses over itself for a first time as it enters the first lower lace guide (48) at an entrance point. As shown in FIG. 1, this area can be referred to as the first criss-crossing zone ("X"). The lace (30) travels through the first lower lace guide (48) and then exits this lace guide (48) at an exit point. The lace (30) then extends upwardly and crosses over itself for a second time until its pathway ends at a termination plate (56) attached to the power shroud (24). This area can be referred to as the second criss-crossing zone ("Y"). The lace guides and termination plate can be made of tightly woven fibers, molded plastics, metals, or other suitable materials that are engineered to conform under tension.

The criss-crossing lace (30) slidably engages the upper and lower lace guides and criss-crosses the gap (57) located between the power shroud (24) and lower chip (40), thereby bringing and holding the power shroud (24) in place. As the lace (30) is tightened via the lace tightening assembly (60), the power shroud (24) is pulled in a downward direction as represented by Arrow A. An angled force is exerted on the power shroud (24) to pull the shroud (24) downwardly in the direction of Arrow A. The lace guides have low friction and this ensures that the lace (30) can be pulled through the guides smoothly and tightly. The length between the entrance and exit points of the lace guides and pathway of the lace (30) is discussed further below.

In different embodiments, the length of the power shroud (24) may vary. For example, in some embodiments, the length (L1) of the power shroud (24) may be in the range of about 0.5 to about 2.5 inches. In one example, the length (L1) of the power shroud is about 1.25 inches. In general, the power shroud (24) typically covers about 10% to about 80% of the surface area of the shoe upper (12).

The width of the power shroud (24) also may vary. For example, in some embodiments, the width (W1) of the power shroud (24) may be in the range of about 0.50 to about 2.50 inches. In one example, the width (W1) of the power shroud is about 1.75 inches. The width of the power shroud (24) should be greater than the width of the tongue member of the instep region (18). In this way, the power shroud (24) extends transversely over the tongue member (22).

The angled forces being applied to the power shroud (24) also will depend upon the length and position of the lace guides. In FIGS. 1-2, the lace guides are shown in an angled position. The upper lace guides (44, 46) are substantially parallel to the lower lace guides (48, 50). As discussed above, the lace (30) enters a given lace guide at an entrance point and exits the lace guide at an exit point. The length between the entrance and exit points of the lace guides can vary. The lace guides can be made of tightly woven fibers, molded plastics, metals, or other suitable materials that are engineered to conform under tension. Normally, the lengths of the lace guides are in the range of about 5 to about 50 mm. In one example, the lace guides have a length of about 20 mm.

The angled forces being applied to the power shroud (24) also will depend upon the gaps between the lace guides. As discussed above, after the lace (30) exits the first upper lace guide (44) at the exit point, it enters the second lower lace guide (50) and then exits the second lower lace guide. The gap (Ga1) between the first upper lace guide (44) and second lower lace guide (50) is generally in the range of about 0.100 to about 2.000 inches and preferably in the range of about 0.125 to about 1.750 inches.

After exiting the second lower lace guide (50), the lace (30) enters the second upper lace guide (46). The gap (Ga2) between the second lower lace guide (50) and second upper lace guide (46) is generally in the range of about 0.100 to about 2.000 inches and preferably in the range of about 0.125 to about 1.750 inches. The lace (30) then crosses over itself and enters the first lower lace guide (48) at an entrance point. The gap (Ga3) between the second upper lace guide (46) and first lower lace guide (48) may be about 0.100 to about 2.000 inches and preferably in the range of about 0.125 to about 1.750 inches. The lace (30) then exits the first lower lace guide (48); crosses over itself for a second time; and ends at a termination plate (56) attached to the power shroud (24). The gap (Ga4) between the first lower lace guide (48) and termination plate (56) may be about 0.100 to about 2.000 inches and preferably in the range of about 0.125 to about 1.750 inches.

Channel

Referring back to FIGS. 1 and 2, as discussed above, the upper (12) includes a lateral lace channel (52) extending in a transverse direction from the heel region (17) to the instep region (18). The lace (30) is disposed in the channel (52) and as it exits the channel, it forms a loop between the power shroud (24) and the lower chip (connecting piece) (40). The lateral lace channel (52) contains plastic tubing (not shown) for holding and guiding the lace (30) through the pathway in the channel (52). The lace (30) exits the lace channel (52) through an eyelet guide (54).

Lace Tightening System

Any suitable lace tightening assembly (60) can be used in accordance with the present invention. Examples of suitable lace tightening systems include, but are not limited to, systems available from Boa Technology, Inc. (Denver, CO 80216); FITGO Technology Co., Ltd., Technology Part GuShu Industrial BaoAn, District ShenZhen, China; ATOP Lacing Systems, Yu Chen Plastic Ent. Co. Ltd., Taichung, Taiwan; and QUICKFIT Lacing Systems, Click Medical (Steamboat Springs, CO 80487). Other lace tightening systems also may be used in accordance with the present invention. Spool (reel) systems are described in the patent literature and such systems can be used in accordance with this invention. For example, such spool tightening systems are disclosed in Hammerslag, U.S. Pat. No. 7,591,050, and Hammerslag, U.S. Pat. No. 6,289,558, the disclosures of which are incorporated herein by reference. The lace tightening assembly (60) can be disposed anywhere in the heel region, preferably it is mounted on the shoe upper (12) in the center of the heel region as shown in FIG. 1. In other embodiments, the lace tightening assembly (60) can be disposed on the tongue member. In still other embodiments, the assembly (60) can be disposed in a remote region on the shoe upper (12). FIG. 1 shows one embodiment of a lace tightening assembly (60) that can include a rotary dial (62) that covers a spool (not shown) located within a housing (not shown). The housing includes a flange that allows the housing to be stitched or riveted onto the shoe upper (12).

The lace (30) is fed into the lace tightening assembly (60) and wound around the spool. The spool is rotatably mounted to the shoe upper (12) so that turning the rotary dial (62) in a first direction will wind more of the lace segment around the spool. This decreases the effective length of the lace (30). Turning the rotary dial (62) in a second direction will unwind the lace segment from the spool, thereby increasing the effective length of the lace (30). In some embodiments, the first direction will be clockwise, and the second direction will be counter-clockwise. In other embodiments, the first direction will be counter-clockwise, and the second direction will be clockwise.

Turning the dial (62) reduces the length of the lace (30) by winding the lace around the spool as described above. Tightening the lace (30) pulls on the power shroud (24), because the lace is threaded through the eye guide (54) and lace guides (44, 46, 48, and 50) attached to the power shroud (24) and lower chip (40). This tightening of the lace (30) cinches the power shroud (24) downwardly, in the direction of the Arrow A, and towards the outsole (16).

To loosen the lace (30), a person's hand pulls-up on the dial (62), and this motion causes the lace to unwind. Pulling-up on the dial provides a way for quickly releasing the lace tightening system. The effective length of the lace (30) is lengthened and slack returns to the lace. This slackened lace (30) allows the power shroud (24) and shoe upper (12) to loosen-up so the foot may be more easily pulled out.

Suitable lace tightening assemblies (60) are available from a number of suppliers including, but not limited to, Boa Technology, Inc. (Denver, CO 80216). As shown in FIGS. 1-4, the lace tightening assembly (60) is mounted in the heel region of the shoe upper (12). In one embodiment, the mounted dial (62) is first pushed inwardly to engage the lace tightening system. The dial (62) is then rotated in a clockwise direction to tighten the lace (30). To loosen the lace (30), the dial (62) is rotated in a counter-clockwise direction. In this manner, the tension on the lace (30) can be adjusted. The tension can be incrementally increased or decreased. In a second embodiment, the dial (62) is pushed inwardly to engage the tightening system. Then, the dial (62) is turned in a clockwise direction to tighten the lace (30). The dial (62) can be pulled-out for a quick release of the tightening system and loosening of the lace (30). In a third embodiment, the dial (62) is rotated in a counter-clockwise direction to tighten the lace (30). To loosen the lace (30), the dial (62) is rotated in a clockwise direction.

Outsole

Turning to FIG. 4, one embodiment of the outsole (16) that can be used in the shoe (10) of this invention is illustrated. The outsole (16) also includes a lateral side (66) and a medial side (68). Lateral side (66) and medial side (68) extend through each of the foot regions (21, 23, and 25) and correspond with opposite sides of the outsole (16). The lateral side or edge (66) of the outsole is the side that corresponds with the outer area of the foot of the wearer. The lateral edge (66) is the side of the foot of the wearer that is generally farthest from the other foot of the wearer (that is, it is the side closer to the fifth toe [little toe].) The medial side or edge (68) of the outsole is the side that corresponds with the inside area of the foot of the wearer. The medial edge (68) is the side of the foot of the wearer that is generally closest to the other foot of the wearer (that is, the side closer to the hallux [big toe].) The lateral and medial sides extend around the periphery or perimeter (70) of the outsole (16) from the anterior end (72) to the posterior end (74) of the outsole. As shown in FIG. 4, the outsole (16) includes a metatarsal or forefoot region (21) positioned generally under a wearer's metatarsal bones, an arch or mid-foot region (23) positioned generally under a wearer's foot arch, and a calcaneus or rear-foot region (25) positioned generally under a wearer's calcaneus bone.

The regions, sides, and areas of the outsole as described above are not intended to demarcate precise areas of the outsole. Rather, these regions, sides, and areas are intended to represent general areas of the outsole. The upper (12) and midsole (14) also have such regions, sides, and areas. Each region, side, and area also may include anterior and posterior sections.

As further shown in FIG. 4, the bottom surface of the outsole (16) may further include spikes or cleats (34). The attached cleats provide additional traction between the shoe and ground surface. If such spikes or cleats (34) are present, they are preferably releasably fastened to sockets (receptacles) (35) in the outsole (16). The spike (34) may be inserted and removed easily from the receptacle (35). Normally, the spike (34) may be secured in the receptacle (35) by inserting it and then slightly twisting it in a clockwise direction. The spike (34) may be removed from the receptacle (35) by slightly twisting it in a counter-clockwise direction. The outsole (16) may include any suitable number of cleats, and the cleats can be arranged in a wide variety of patterns. The cleats are preferably made of a plastic material, since most golf courses require that golfers use non-metal cleats. The outsole (16) also may include one or more flex channels (36) that extend transversely or longitudinally through it. The flex channels (36) are preferably positioned to provide bending regions in the outsole (16) that correspond to the natural bending of the foot during walking.

Preferably, the outsole (16) has a plurality of flex channels (36) and each flex channel extends in a generally transverse direction from a lateral edge (66) or a medial edge (68) to an interior region (75) of the outsole. The flex channels (36) are substantially linear with a relatively wide end and a relatively narrow opposite end. That is, the channels (36) are generally tapered and have a spire-like shape. A hard, base material surrounds the flex channels (36). As discussed above, the outsole (16) preferably includes a plurality of receptacles for attaching and removing a plurality of spikes (34). As shown in FIG. 4, the receptacles (35) are positioned adjacent to the pointed ends of the flex channels (36).

The hard, base material (80) provides stiffness for support and stability while the flex channels (36) allow the outsole (16) to bend when a golfer walks or swings. At least one flex channel (36) may extend from a lateral edge to a point in the interior region of the outsole that is adjacent to the receptacle. At least one flex channel (36) may extend from a medial edge to a point in the interior region of the outsole that is adjacent to the receptacle.

As discussed above, the metatarsal (21), arch (23), and calcaneus regions (25) include flex channels (36), which are voids in the outsole (16), extending across the outsole (16). Each spire-shaped flex channel (36) extends in a transverse direction from an exterior edge of the outsole to an interior region (75) of the outsole (16). The spire-shaped flex channels (36) are substantially parallel to each other. The pointed end of the spire-shaped flex channel (36), where it terminates in the interior region, is adjacent to a receptacle (35).

The flex channels (36) allow the outsole (16) to flex and bend when a golfer walks or swings the club. The flex channels (36) generally run along the interior region (75) between the medial edge (68) and lateral edge (66) of the outsole (16). In the embodiment shown in FIG. 4, the outsole (16) includes four flex channels (36) across the metatarsal portion (21); two flex channels (36) across the arch portion (23) and two flex channels (36) across the calcaneus portion (25). It is recognized, however, that the total number of flex channels (36) may vary depending on the desired flexibility of the outsole (16) and size of the shoe (10). Similarly, the depth, width, and shape of the flex channels (36), may be varied depending on desired flexibility of the outsole (16).

Still referring to FIG. 4, the hard, base material (80) extends across the outsole (16) and surrounds the flex channels (36). The hard, base material (80) provides stiffness and stability to the outsole (16). The hard, base material (80) may be a material such as thermoplastic polyurethane or the like, and may have a hardness of at least 80 Shore A. The hard, base material (80) does not constitute the entire outsole (16) of the shoe (10). Rather, as discussed above and shown in FIG. 4, the flex channels (36) constitute a portion of the outsole of the shoe. The flex channels (36) are made of a relatively soft material such as EVA. In one preferred embodiment, the flex channels (36) comprise the same EVA or other material used to make the midsole (14) of the shoe. The exposed midsole (14) areas of the shoe form the flex channels (36). The midsole (that is, the flex channels) is plainly visible to a person looking at the outsole (16) of the shoe. As discussed above, the outsole (16) also has a series of traction elements or members (32) and spikes (34) extending from the hard, base material (80), which provide traction between the outsole (16) and a ground surface.

It should be understood that the above-described outsole (16) shown in FIG. 4 represents only one example of an outsole that can be used in the shoe constructions of this invention and other outsoles can be used without departing from the spirit and scope of this invention. For example, other suitable outsoles include the constructions described in Bidal, U.S. Patent Applications Publications 2020/0077734-A1 and US 2020/0146389-A1; Bento, U.S. Patent Applications Publication 2020/0046072-A1; and Bacon, U.S. Pat. Nos. 9,999,275 and 10,595,585.

Forces Applied to the Foot

During normal golf play, a golfer makes shots with a wide variety of clubs. As the golfer swings a club when making a shot and transfers their weight, the foot absorbs tremendous forces. In many cases, when a right-handed golfer is addressing the ball, their right and left feet are in a neutral position. As the golfer makes their backswing, the right foot presses down on the medial forefoot and heel regions, and, as the right knee remains tucked in, the right foot creates torque with the ground to resist external foot rotation. Following through on a shot, the golfer's left shoe rolls from the medial side (inside) of their left foot toward the lateral side (outside) of the left foot. Meanwhile, their right shoe simultaneously flexes to the forefoot and internally rotates as the heel lifts.

As discussed above, significant pressure is applied to the foot at various stages in the golf shot cycle. In the present invention, the lace tightening system helps provide support and stability to the sides of the foot and to the heel region. As shown in FIGS. 1-4, the lace extends only along one side of the shoe, and yet it still provides an optimum closure system and gives a comfortable fit. There is only one strand of lace. That is, a single lace (30) is shown in FIGS. 1-4 extending along only the lateral side of the shoe upper (12), where the upper includes a lateral lace channel (52) extending in a transverse direction from the heel region (17) to the instep region (18). The lace (30) is disposed in the channel (52) and as it exits the channel, it forms a loop between the power shroud (24) and the lower chip (40) before terminating at the termination plate (56). In other examples, the lace can be threaded so that it only extends along the medial side of the upper (12).

The lace tightening system (60) of this invention helps hold and support the medial and lateral sides of the golfer's foot and the heel region as he/she shifts their weight when making a shot. The foot is held in place downwardly and rearwardly by the lace tightening system (60). Thus, the golfer has better stability and balance when making a shot. This support and contoured fit help the golfer in every phase of the game including walking the course. The shoe (10) fits snugly around the foot, but the shoe is not overly rigid. The shoe (10) allows the foot to move a certain degree inside of the shoe. That is, the shoe allows for some movement of the foot, but the motion of the foot is controlled. The lace tightening system of this invention helps provide a structured and smooth, comfortable fit. The lace tightening system helps control the motion of the foot by applying forces on the medial and lateral sides and heel regions. The shoe holds and support the foot without sacrificing flexibility. Thus, the shoe provides a snug and yet comfortable fit. In one embodiment, the tension in the lace as it passes through the different lace guides is substantially the same. In other embodiments, the tension can vary. Adjusting the lace provides a substantially uniform application of force against the shoe upper. The system of the present invention distributes the lateral, medial, and downward tightening forces along the length of the foot. Thus, there is a uniform tightening of the shoe against a wearer's foot. This helps prevent creating pressure points on the wearer's foot. Furthermore, the lace tightening system can be incrementally adjusted to tighten or loosen the lace as desired by the wearer of the shoe.

Other Shoe Constructions

It should be understood that the above-described shoe construction which generally includes: a) an upper (12); b) an outsole (16); and c) a midsole (14) connecting the upper (12) and outsole (16), wherein the upper includes a power shroud (24) that is pulled over the instep region (18) and towards the lateral side (41) of the upper when the lace (30) is tightened via a lace tightening system (60) and that also includes a lower chip (40) represents only one example of a shoe construction of this invention. As discussed above, the unique upper construction and lace tightening system helps provide the golfer with high stability and balance on various surfaces. However, it is recognized that other upper and shoe structures can be used without departing from the spirit and scope of the present invention.

For example, turning to FIGS. 5-8, a second embodiment of a shoe upper (12) having a similar construction to the shoe upper in FIGS. 1-4 is shown. In this embodiment, the lace (30) travels through the first lower lace guide (48) and then exits this lace guide (48) at an exit point similar to the lace pathway described above. The lace (30) then extends upwardly and crosses over itself for a second time ("Y"-second criss-crossing zone). However, instead of the lace (30) ending its pathway at a termination plate (56) attached to the power shroud (24) as shown in FIGS. 1-4, the lace (30) continues extending over the instep region (18) and is threaded through a third upper lace guide (53) attached to the upper posterior edge of the power shroud (24) and adjacent to the tongue member (22).

Thus, as shown in FIGS. 5-8, in this embodiment, the same lace (30) extends along both sides of the shoe. That is, a single lace (30) is shown in FIGS. 5-8 extending along the lateral and medial sides of the shoe upper (12). This lace tightening system with the lace (30) extending over the instep region (18) so that it has a lateral and medial pathway provides a particularly secure closing system. In this embodiment, the upper (12) includes a lateral lace channel (52) and a medial lace channel (55) extending in a transverse direction from the instep region (18) to the heel region (17). Thus, the lace exits the lateral lace channel (52) and is threaded through the upper and lower lace guides on the lateral side of the upper (12) as described above. The same lace (30) then passes through the third upper lace guide (53) and over to the medial side, where it enters the medial lace channel (55). The medial lace channel (55) extends in a transverse direction from the instep region (18) back to the heel region (17). There, the lace wraps back around the spool of the lace tightening assembly (60). Thus, the lace (30) forms a continuous loop so that the lace extends along the lateral and medial sides and around the heel region of the shoe upper (12). Adjusting the lace (30) provides a substantially uniform application of force against the shoe upper on both the lateral and medial sides. There is a uniform tightening of the shoe against a wearer's foot. This helps prevent pressure points on the wearer's foot.

Figure 9:
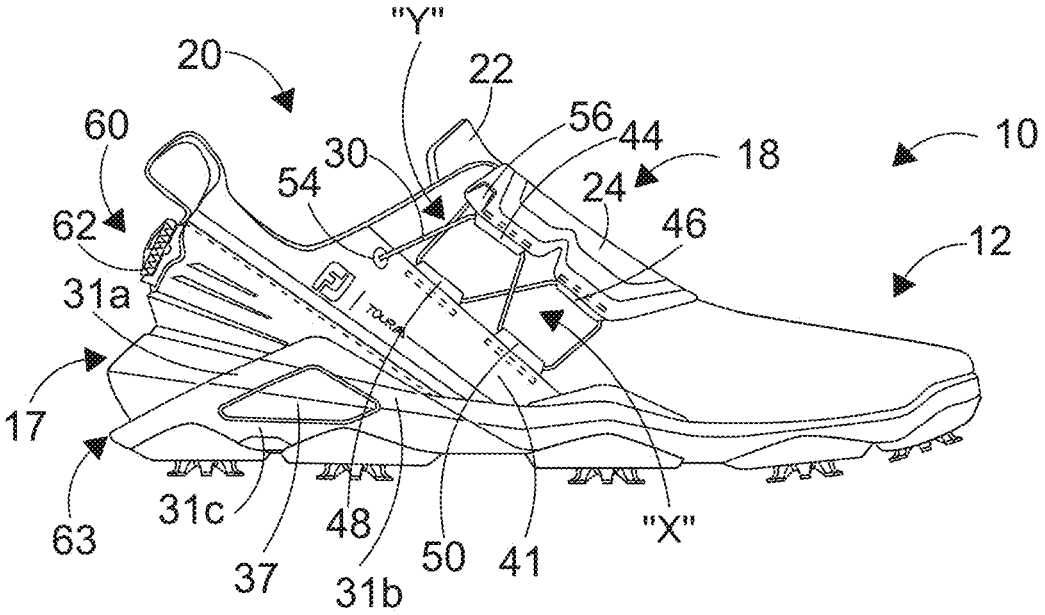
FIG. 9 is a lateral side view of a third example of a golf shoe of the present invention showing the upper portion in detail.
Figure 10:
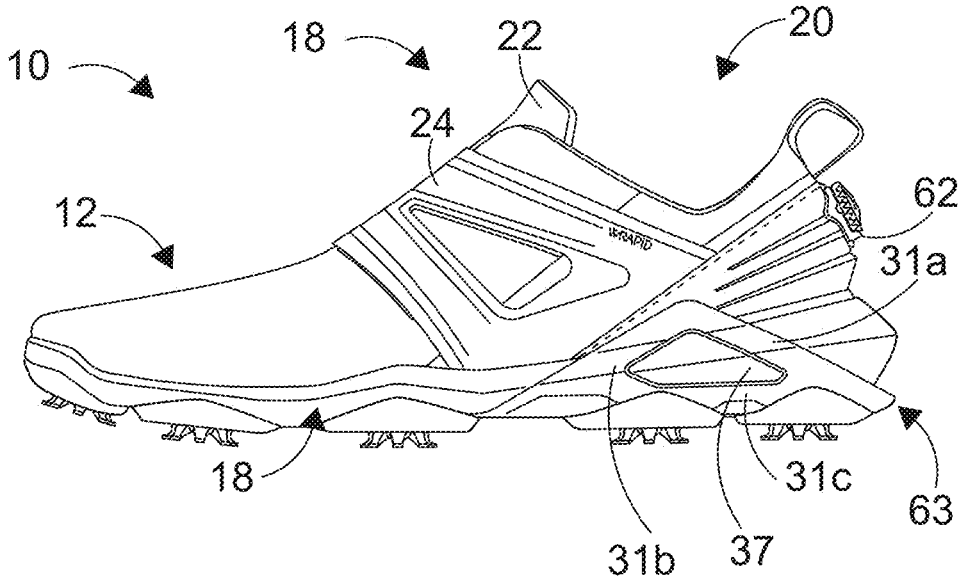
FIG. 10 is a medial side view of the golf shoe shown in FIG. 9.

Referring to FIGS. 9 and 10, in a third embodiment, the shoe upper (12) has a unique design with a skeletal frame having an "A Frame-shaped" structure (63) extending upwardly from the midsole (14) that provides additional stability and support. The A-Frame skeletal structure (63) extends along the lateral (41) and medial (38) sides of the shoe (10). The A-Frame skeletal structure is a unitary, integral structure in the form of a triangle as shown in the lateral view (FIG. 9) and medial view (FIG. 10) having three surfaces or segments (31*a*, 31*b*, and 31*c*). These segments are joined together to define an aperture (37) as shown in FIGS. 9 and 10. The A-Frame skeletal structure (63) helps provide structural support and rigidity while still being lightweight. The relatively hard and durable A-Frame skeletal structure (63) overlaps the upper (12) and helps provide stiffness and stability to the shoe (10). The A-Frame skeleton (63) is preferably made of thermoplastic polyurethane (TPU). Other suitable durable materials can be used. As the A-Frame skeletal structure (63) extends onto the upper (12), it works with the power shroud (24) to provide a stable platform. The A-Frame skeletal structure (63) complements the power shroud (24) nicely. Both structures work together to enhance the support and stability features of the shoe.

In this embodiment, the lace (30) is threaded through the upper and lower lace guides in the same manner as illustrated in FIGS. 1-4 and described above. Particularly, the first upper lace guide (44), which is attached to the power shroud (24) is oriented in an angled position. The first upper lace guide (44) can be attached to the power shroud (24) by stitching, adhesives, or any other suitable fastening means. The lace (30) extends from a lace tightening assembly (60) in the heel region (17) and exits a trumpet or eyelet guide (54). The lace (30) then enters the first upper lace guide (44) at an entrance point and exits the lace guide (44). After the lace (30) exits the first upper lace guide (44) at the exit point, it passes downwardly and enters the second lower lace guide (50), which is attached to the lateral side (41) of the upper. The lace (30) travels through the second lower lace guide (50) and then exits the lace guide (50) at an exit point. After exiting the second lower lace guide (50), the lace is threaded upwardly to the second upper lace guide (46), where it enters the guide (46) at an entrance point. Then, the lace (30) travels through the second upper lace guide (46) and exits the lace guide (46).

The lace (30) then passes downwardly and crosses over itself for a first time as it enters the first lower lace guide (48), which is attached to lateral side (41) of the upper. As shown in FIG. 9, this area can be referred to as the first criss-crossing zone ("X"). The lace (30) travels through the first lower lace guide (48) and then exits this lace guide (48) at an exit point. The lace (30) then extends upwardly and crosses over itself for a second time until its pathway ends at a termination plate (56) attached to the power shroud (24). This area can be referred to as the second criss-crossing zone ("Y"). As shown in FIGS. 9-10, the lace (30) extends only along one side of the shoe, and yet it still provides an optimal closure system and gives a comfortable fit. There is only one strand of lace. That is, a single lace (30) is shown in FIGS. 9-10 extending along only the lateral side of the shoe upper (12). In other examples, the lace can be threaded so that it only extends along the medial side of the upper (12).

Figure 11:
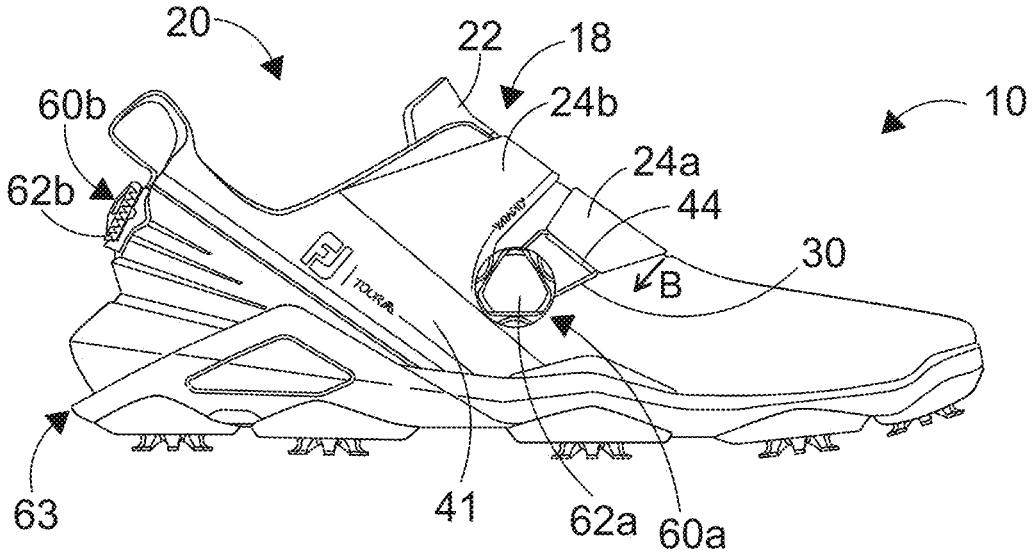
FIG. 11 is a lateral side view of a fourth example of a golf shoe of the present invention showing the upper portion in detail.
Figure 12:
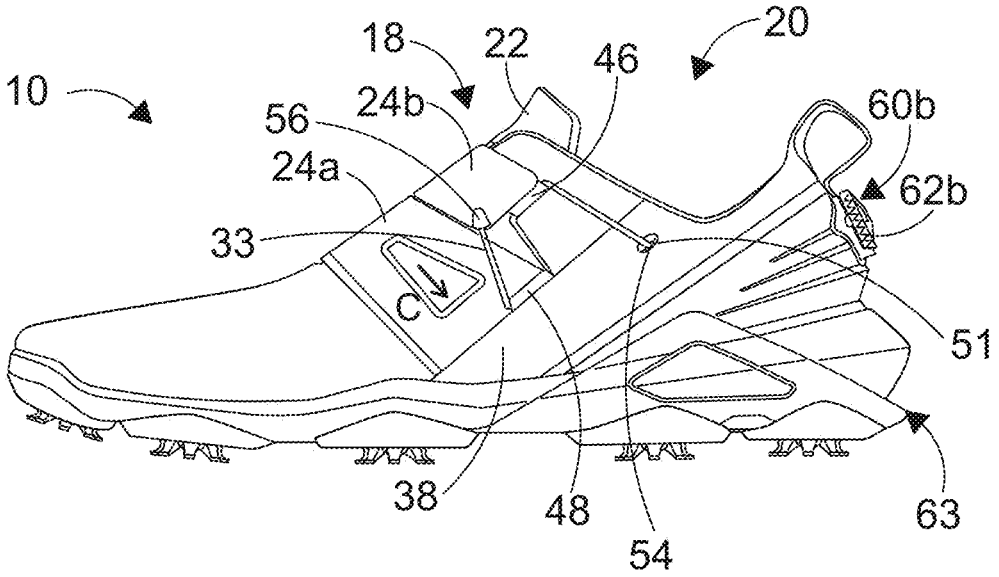
FIG. 12 is a medial side view of the golf shoe shown in FIG. 11.

Turning to FIGS. 11 and 12, a fourth embodiment of the shoe (10) is shown, wherein there are two lace tightening assemblies (60*a*, 60*b*) and two power shrouds (24*a*, 24*b*). In this embodiment, the upper portion (12) generally includes an instep region (18) with an opening (20) for inserting a foot. The instep region (18) includes a tongue member (22), and two power shrouds (24*a*, 24*b*). The first power shroud (24*a*) extends from medial edge (38) of the upper (12), overlies the tongue member (22), and extends onto the lateral side (41). As the lace (30) is tightened, the first power shroud (24*a*) is pulled downwardly so that it covers the instep region (18). The first power shroud (24*a*) is pulled over the instep region (18) and towards the lateral side (41) when the lace (30) is tightened via the lace tightening system (60*a*). In this way, the shoe (10) is fitted securely and comfortably around the foot. As shown in FIGS. 11-12, the first power shroud (24*a*) also includes: i) a first upper lace guide (44). Meanwhile, the second power shroud (24*b*) extends from the lateral side (41) of the upper (12), overlies the tongue member (22), and extends to the medial side (38) (FIG. 12). The second power shroud (24*b*) also includes: i) a second upper lace guide (46). Additionally, a first lower lace guide (48) is shown fastened to the medial side of the upper (12) (FIG. 12).

As shown in FIGS. 11-12, the first upper lace guide (44), which is attached to the first power shroud (24*a*) is oriented in an angled position. The first upper lace guide (44) can be attached to the first power shroud (24*a*) by stitching, adhesives, or any other suitable fastening means. The first lace (30) exits the first lace tightening assembly (60*a*) mounted on the upper (12) and enters the first upper lace guide (44) at an entrance point and then exits the lace guide (44). The lace guide (44) has low friction and this ensures the lace (30) can be pulled through the guide (44) smoothly and tightly. The first upper lace guide (44) in this embodiment of the shoe (10) can have the same dimensions as the lace guides discussed above.

After the first lace (30) exits the first upper lace guide (44) at the exit point, it is threaded downwardly and comes back to the same first lace tightening system (60*a*). As discussed above, the lace tightening assembly (60*a*) can include a dial (62*a*) that covers a spool (not shown) for winding the lace that is located within a housing. In one embodiment, the dial (62*a*) is first pushed inwardly to engage the lace tightening system (60*a*). The dial (62*a*) is then rotated in a clockwise direction to tighten the lace (30). As the first lace (30) is tightened, the first power shroud (24*a*) is pulled in a downward direction as represented by Arrow B—this is the angled force acting on the power shroud (24*a*). To loosen the lace (30), the dial (62*a*) is rotated in a counter-clockwise direction. In this manner, the tension on the first lace (30) can be adjusted. The tension can be increased or decreased. The dial (62*a*) may be pulled-out for a quick release of the lace tightening system (60*a*) and loosening of the lace (30).

Meanwhile, the second power shroud (24*b*) extends from the lateral side (41), overlies the tongue member (22), and extends onto the medial side (38). The second power shroud (24*b*) includes: i) a second upper lace guide (46). Also, a first lower lace guide (48) is shown fastened to the medial side (38) of the upper (12). The second power shroud (24*b*) is pulled over the instep region (18) and is tightened via the lace tightening system (60*b*) mounted on the heel region.

The second lace (33) extends from the second lace tightening system (60*b*) in the heel region, is threaded through a medial lace channel (51), and as it exits the channel through a trumpet or eyelet guide (54), it forms a loop between the upper (46) and lower (48) lace guides. The second lace (33) first enters the second upper lace guide (46) at an entrance point and exits the lace guide (46). After the lace (33) exits the second upper lace guide (46), it passes downwardly and enters the first lower lace guide (48) at an entrance point. The lace (33) travels through the first lower lace guide (48) and then exits the lace guide (48). After exiting the first lower lace guide (48), the lace (33) extends upwardly until its pathway ends at a termination plate (56) attached to the second power shroud (24*b*). The lace guides have low friction and this ensures that the lace can be pulled through the guides smoothly and tightly. The second upper lace guide (46) and first lower lace guide (48) in this embodiment of the shoe can have the same dimensions as the lace guides discussed above.

In this embodiment, the second lace tightening assembly (60*b*) is located on the heel region of the upper (12). As shown in FIGS. 11-12 and discussed above, the lace tightening assembly (60*b*) can include a dial (62*b*) that covers a spool (not shown) positioned within a housing. In one embodiment, the dial (62*b*) is first pushed inwardly to engage the lace tightening system (60*b*). The dial (62*b*) is then rotated in a clockwise direction to tighten the lace (33). As the second lace (33) is tightened, the second power shroud (24*b*) is pulled in a downward direction as represented by Arrow C. The second power shroud (24*b*) is pulled downwardly in the direction of Arrow C—this is the angled force acting on the second power shroud (24*b*). To loosen the second lace (33), the dial (62*b*) is rotated in a counter-clockwise direction. In this manner, the tension on the lace (33) can be adjusted. The tension can be incrementally increased or decreased. The dial (62*b*) may be pulled-out for a quick release of the lace tightening system (60*a*) and loosening of the second lace (33).

Referring to FIGS. 13-16, in a fifth embodiment of the upper construction, there is a single lace tightening assembly (81) and two power closure straps (82*a*, 82*b*). In this embodiment, the upper portion (12) generally includes an instep region (18) with an opening (20) having a heel collar (79) for inserting a foot. The upper (12) may include a full bootie construction (83) around the collar (79) of the foot-receiving opening (20). The bootie construction (83) can enhance comfort and provide resistance against cold and wet environments. Other bootie constructions (83) are made of breathable materials to provide comfort in hot and humid environments, for example, Southern regions, and these booties also can be used in the shoes of the present invention. The bootie (83) can be constructed from a wide variety of fabric and/or foam materials including, but not limited to, Lycra™, Neoprene™, knits, spandex, and spandex blends such as, for example, cotton/spandex, nylon/spandex, and polyester/spandex blends. Laminates such as meshes laminated to foams and liners, for example mesh foam core materials and synthetic rubber and foam materials such as Ariaprene™, available from Tiong Liong Industrial Co., Ltd., can be used. Although the bootie construction (83) is shown being used primarily in the upper illustrated in FIGS. 13-16, this is only one example and should not be considered as limiting. It should be understood the bootie (83) can be used in any of the shoe constructions of this invention. The bootie (83) is particularly effective when the upper (12) is made of a collapsible material such as a knit.

Figure 13:
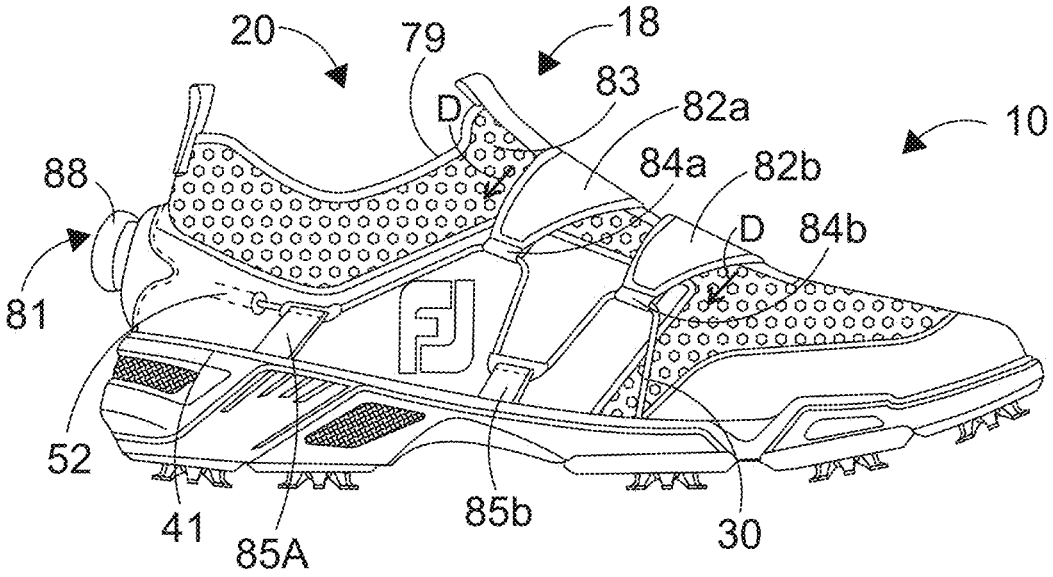
FIG. 13 is a lateral side view of a fifth example of a golf shoe of the present invention showing the upper portion in detail.
Figure 14:
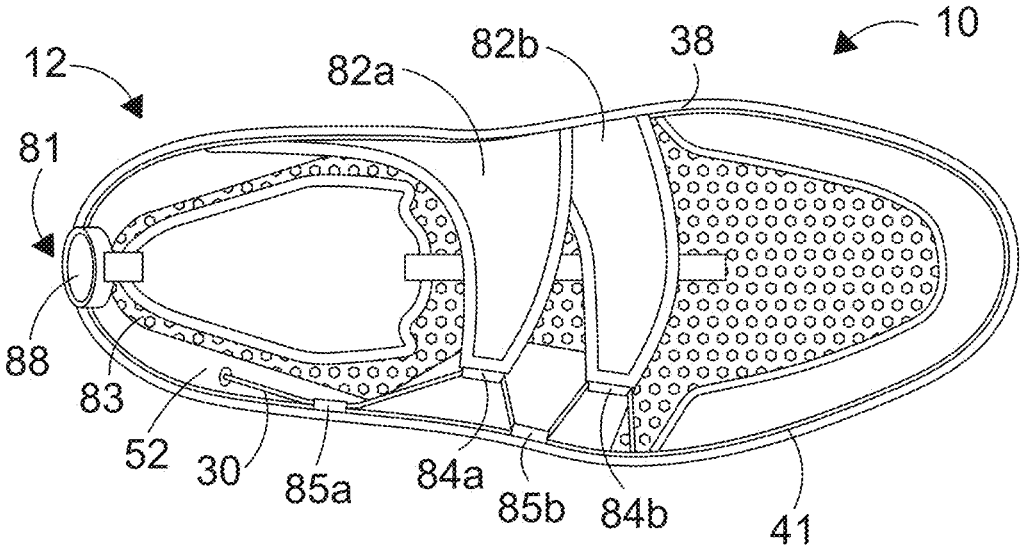
FIG. 14 is a top plan view of the golf shoe shown in FIG. 13.
Figure 15:
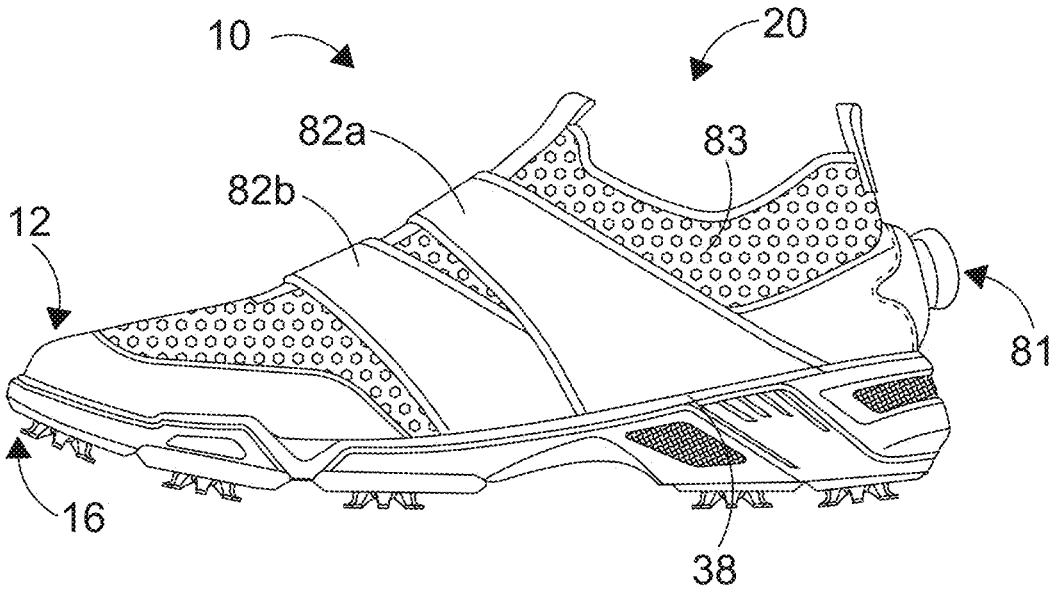
FIG. 15 is a medial side view of the golf shoe shown in FIG. 13.
Figure 16:
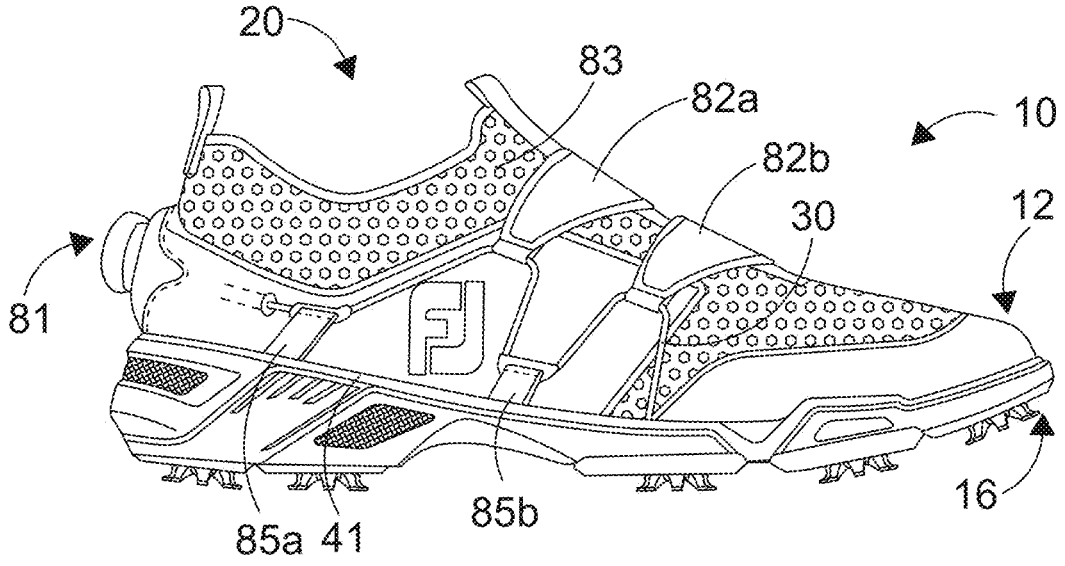
FIG. 16 is a second lateral side view of the golf shoe shown in FIG. 13.

The first power closure strap (82*a*) extends from the medial side of the upper (12), overlies the tongue member (22), and extends onto the lateral side. As shown in FIG. 13, the first power closure strap (82*a*) also includes: i) a first upper lace guide (84*a*). Meanwhile, the second power closure strap (82*b*) also extends from the medial side of the upper (12) and overlies the tongue (22) and extends over to the lateral side. The second power closure strap (82*b*) also includes: i) a second upper lace guide (84*b*). Additionally, a first lower lace guide (85*a*) and second lower lace guide (85*b*) are fastened to the lateral edge or side (41) of the upper (12). As shown in FIGS. 13-16, the lace (30) extends only along one side of the shoe upper (12), and yet it still provides an optimal closure system and gives a comfortable fit. There is only one strand of lace. That is, a single lace (30) is shown in FIGS. 13-16 being threaded along only the lateral side of the shoe upper (12). In other examples, the lace can be threaded so that it only extends along the medial side of the upper (12).

Further, as shown in FIG. 13, the lace (30) extends from the lace tightening assembly (81) in the heel region, is threaded through a lateral channel (52) and as it exits the channel, it forms a loop between the two power closure straps (82*a*, 82*b*) and first and second lower lace guides (85*a*, 85*b*). More particularly, the lace (30) travels through the first lower lace guide (85*a*) and then exits the guide (85*a*) at an exit point. After exiting the first lower lace guide (85*a*), the lace (30) extends upwardly until it enters the first upper lace guide (84*a*) at an entrance point. After the lace (30) exits the first upper lace guide (84*a*) at the exit point, it passes downwardly and enters the second lower lace guide (85*b*). The lace (30) travels through the second lower lace guide (85*b*) and then exits the lace guide (85*b*) at an exit point. After exiting the second lower lace guide (85*b*), the lace (30) extends upwardly and enters the second upper lace guide (84*b*). The lace (30) travels through the second upper lace guide (84*b*) and then exits the guide (84*b*) extends downwardly. The lace (30) passes downwardly until its pathway ends at a termination plate (56) fastened on the lateral edge of the upper (12).

In this embodiment, the single lace tightening assembly (81) is located on the heel region of the upper (12). As shown in FIG. 13 and discussed above, the lace tightening assembly (81) can include a dial (88) that covers a spool (not shown) positioned within a housing. In one embodiment, the dial (88) is first pushed inwardly to engage the lace tightening system (81). The dial (88) is then rotated in a clockwise direction to tighten the lace (30). As the lace (30) is tightened, the first and second power closure straps (82*a*, 82*b*) are pulled in a downward direction as represented by Arrow D. The power closure straps (82*a*, 82*b*) are pulled downwardly in the direction of Arrow D—this is the angled force acting on the first and second power closure straps (82*a*, 82*b*). To loosen the lace (30), the dial (88) is rotated in a counter-clockwise direction. In this manner, the tension on the lace (30) can be adjusted. The tension can be incrementally increased or decreased. The dial (88) may be pulled-out for a quick release of the lace tightening system (81) and loosening of the lace (30).

The power closure straps (82*a*, 82*b*) are preferably made of a lightweight, high-strength fabric material. For example, woven fabric made of polyamides (nylon), aramids such as Kevlar™, polyurethanes, polypropylenes, polyesters, and the like can be used to make the power closure straps (82*a*, 82*b*). Also, spandex or rubber fabric material, for example, styrene-butadiene rubber (SBR) and Neoprene™ synthetic rubber, can be used to form the power closure straps (82*a*, 82*b*). Natural and synthetic rubber materials can be used. Examples of synthetic rubber materials include but are not limited to, polybutadiene, polyisoprene, ethylene-propylene rubber ("EPR"), ethylene-propylene-diene ("EPDM") rubber, styrene-butadiene rubber, styrenic block copolymer rubbers (such as "SI", "SIS", "SB", "SBS", "SIBS", "SEBS", "SEPS" and the like, where "S" is styrene, "I" is isobutylene, "E" is ethylene, "P" is propylene, and "B" is butadiene), polyalkenamers, butyl rubber, nitrile rubber, and blends of two or more thereof. Natural leathers, synthetic leathers, knits, non-woven materials, natural fabrics, and synthetic fabrics also can be used. For example, synthetic textile fabrics made from nylons, polyesters, polyolefins, polyurethanes, rubbers, and combinations thereof can be used. Microfibers and nonwoven materials can be used as well as engineered knit and rolled good fabrics. All of these fiber and fabric structures can be reinforced with different materials. Also, hot-melt thermoplastic polyurethanes (TPUs) can be applied over these structures.

In still other embodiments, the power closure straps (82*a*, 82*b*) can be coupled together with a small strap, stitching, or other suitable fastening means so power closure straps (82*a*, 82*b*) function as a single power shroud structure. In still other embodiments, a single, power closure strap can be used. Such a power closure strap can have a single, integral and unitary structure.

Figure 17:
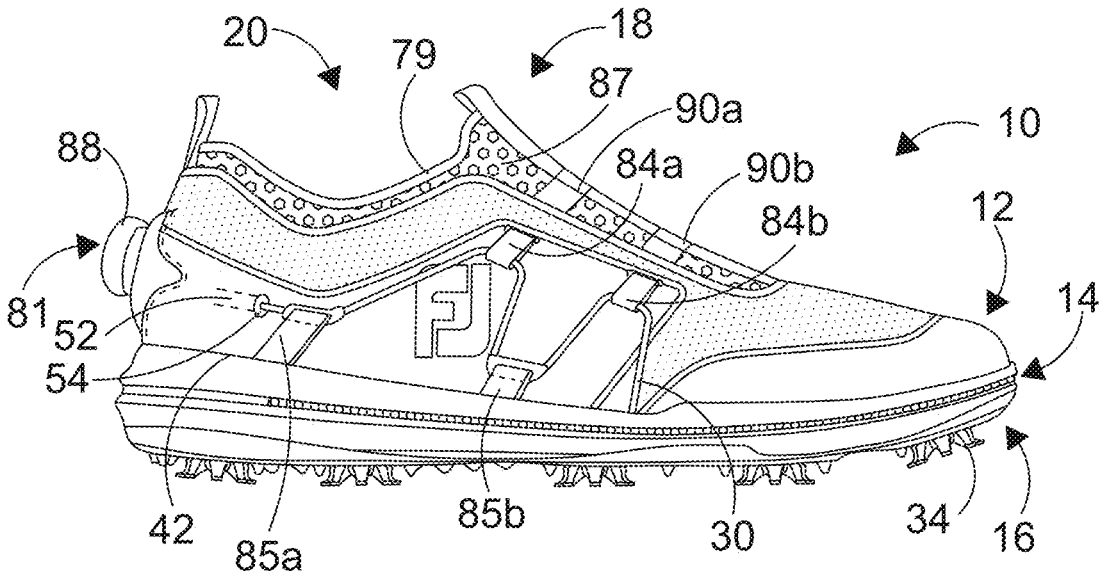
FIG. 17 is a lateral side view of a fifth example of a golf shoe of the present invention showing the upper portion in detail.
Figure 18:
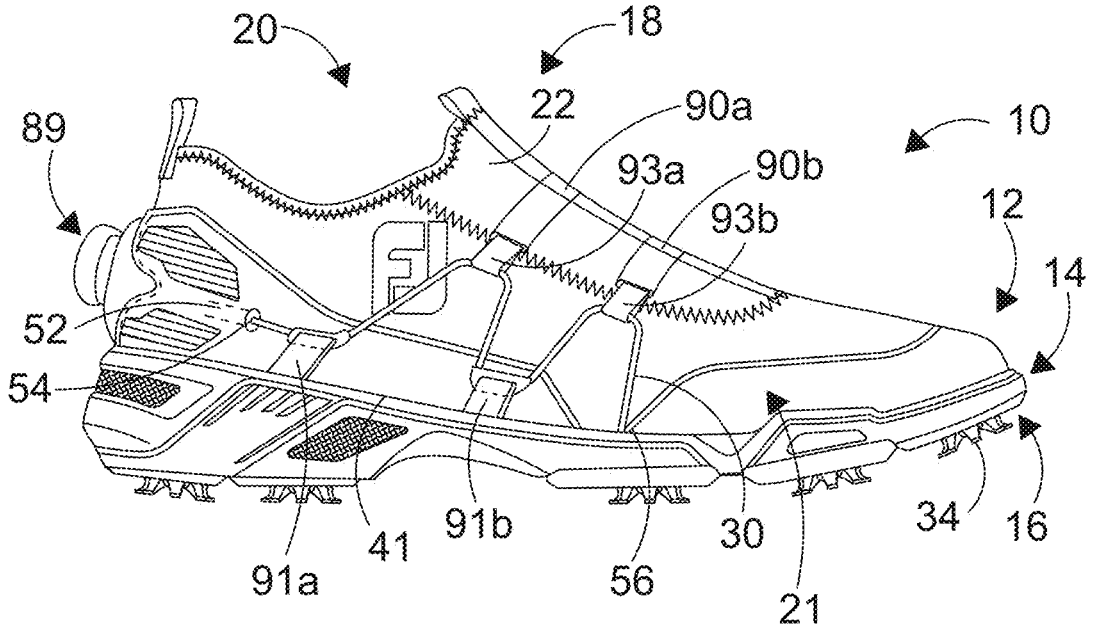
FIG. 18 is a lateral side view of a sixth example of a golf shoe of the present invention showing the upper portion in detail.
Figure 19:
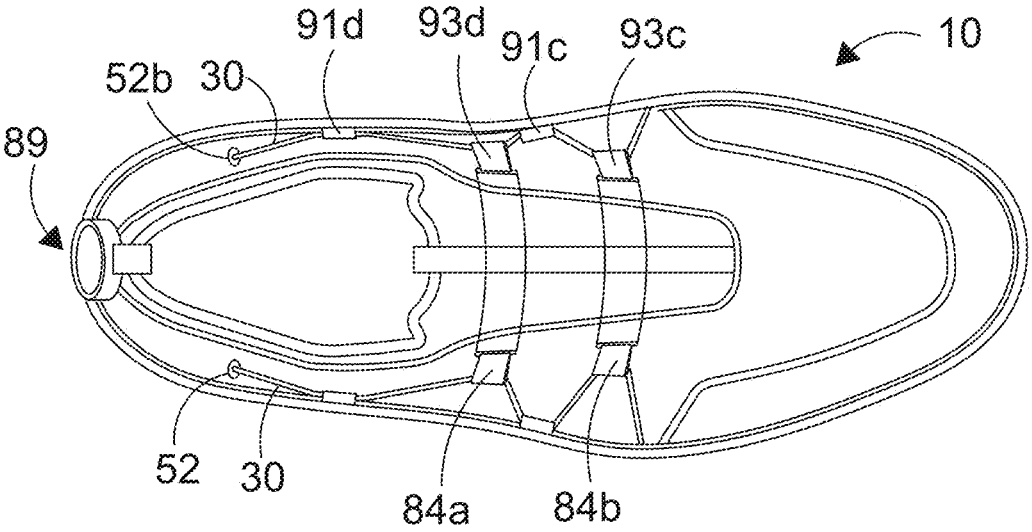
FIG. 19 is a top plan view of the golf shoe shown in FIG. 18.
Figure 20:
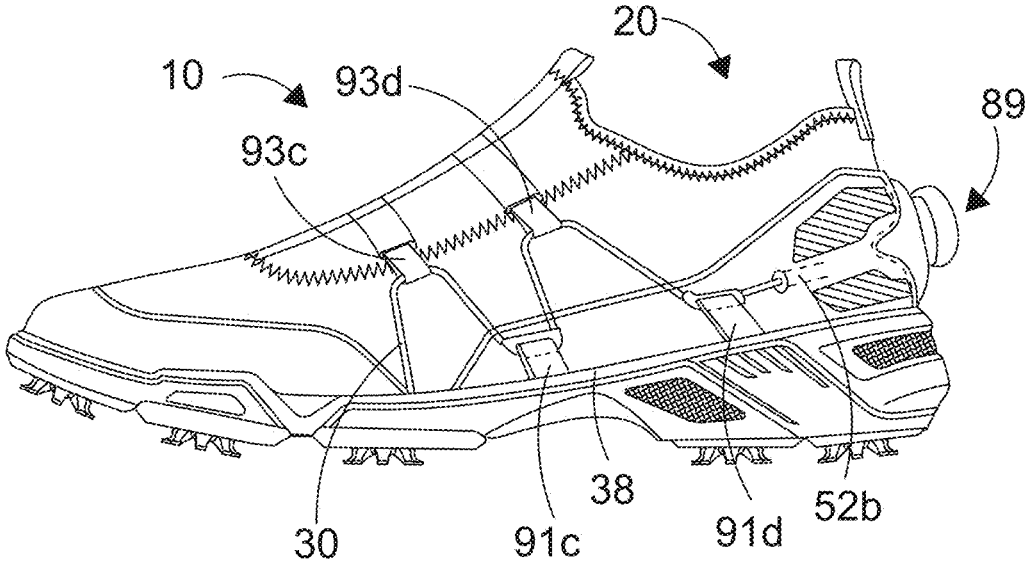
FIG. 20 is a medial side view of the golf shoe shown in FIG. 18.
Figure 21:
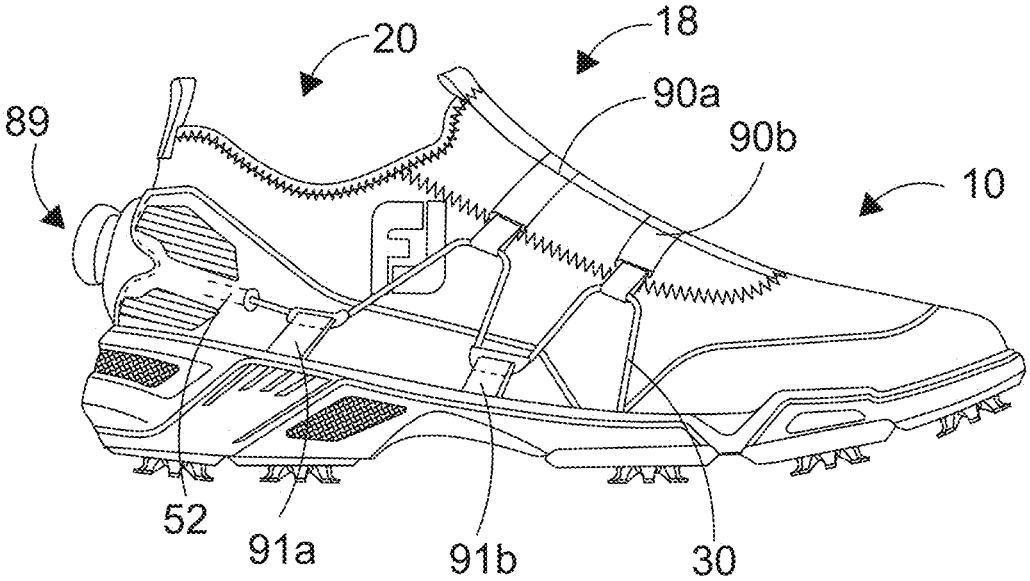
FIG. 21 is a second lateral side view of the golf shoe shown in FIG. 18.
Figure 22:
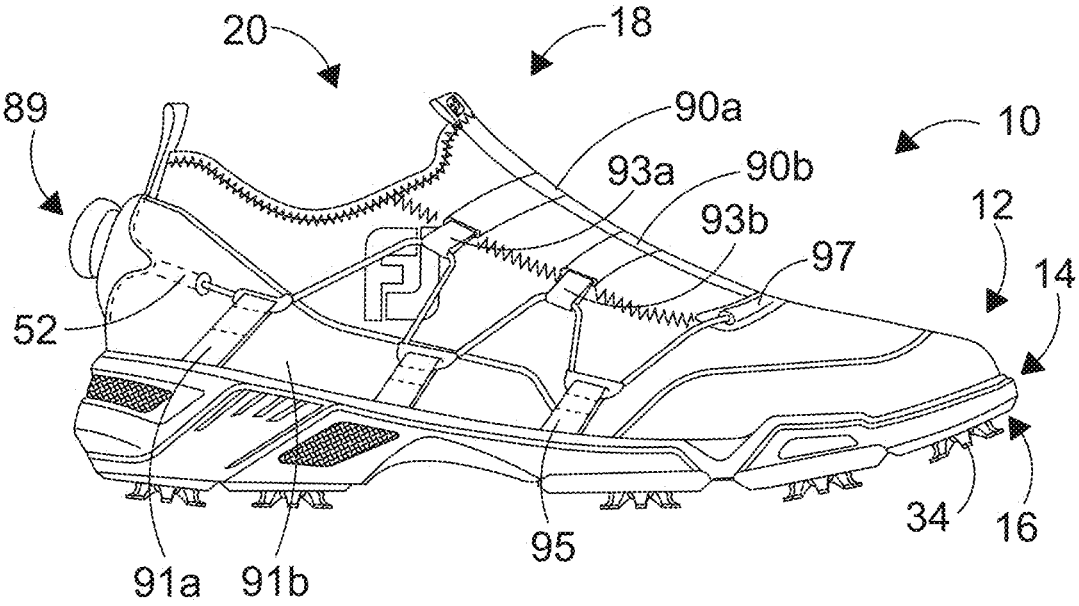
FIG. 22 is a lateral side view of a seventh example of a golf shoe of the present invention showing the upper portion in detail.

Turning to FIG. 17, in a sixth embodiment, the shoe upper (12) has the same construction as the above-described shoe upper shown in FIGS. 13-16, except for the following differences: i) there is a half-bootie construction (87) around the collar (79) of the foot-receiving opening (20) as opposed to the full bootie construction (85) shown in FIGS. 13-16; and ii) there are two power connector webbings (90*a*, 90*b*) that extend through channels (98*a*, 98*b*) instead of the two power closure straps (82*a*, 82*b*) that are shown in FIGS. 13-16.

The power connector webbings (90*a*, 90*b*) extend through channels (98*a*, 98*b*) in the tongue member (22). In other examples, the power connecting webbings (90*a*, 90*b*) can extend inside the bootie, that is, the channels (98*a*, 98*b*) can extend between the tongue member (22) and liner of the bootie (87). The power connecting webbings (90*a*, 90*b*) can be considered as "floating." In still other, examples, the webbings (90*a*, 90*b*) can go over the bootie (87). The power connector webbings (90*a*, 90*b*) can go inside or over the instep region so they extend between the medial and lateral sides of the upper (12). The webbings (90*a*, 90*b*) can be made from any suitable textile material such as, for example, polyamides (nylons), aramids such as Kevlar™ fibers, polyesters, polypropylenes, polyethylenes, polyurethanes, rubbers, and the like. Other suitable fiber and fabric materials that can be sued to make the webbings are described above.

The first power webbing (90*a*) also includes: i) a first upper lace guide (84*a*). The second power webbing (90*b*) also includes: i) a second upper lace guide (84*b*). Additionally, a first lower lace guide (85*a*) and second lower lace guide (85*b*) are fastened to the lateral edge (42) of the upper (12). The lace (30) extends from the lace tightening assembly (81) in the heel region and exits through a trumpet or eyelet guide (54) of the lace channel (52), wherein it enters the lace guides. The lace forms a loop between the two power connector webbings (90*a*, 90*b*) and first and second lower lace guides (85*a*, 85*b*). The lace tightening assembly (81) can be used to tighten and loosen the lace (30) as described above.

Referring to FIGS. 18-21, in a seventh embodiment, the shoe upper (12) also includes two power connector webbings (90*a*, 90*b*). The power connecting webbings (90*a*, 90*b*) can go inside or over the instep region so they extend between the medial and lateral sides of the upper (12). The webbings (90*a*, 90*b*) can be made from any suitable textile material such as, for example, polyamides (nylons), aramids such as Kevlar™ fibers, polyesters, polypropylenes, polyethylenes, polyurethanes, rubbers, and the like. The first power webbing (90*a*) also includes: i) a first upper lace guide (93*a*). The second power webbing (90*b*) also extends from the medial side of the upper (12), overlies the tongue (22), and extends onto the lateral side of the upper (12). The second power webbing (90*b*) also includes: i) a second upper lace guide (93*b*).

The lace (30*a*) extends from the lace tightening assembly (89) in the heel region, is threaded through a lateral lace channel (52*a*) and as it exits the channel through the eyelet (54), it enters the first lower lace guide (91*a*) and then exits the guide (91*a*). After exiting the first lower lateral lace guide (91*a*), the lace (30*a*) extends upwardly until it enters the first upper lateral lace guide (93*a*) at an entrance point and then exits the guide (93*a*). After the lace (30*a*) exits the first upper lateral lace guide (93*a*), it passes downwardly and enters the second lower lateral lace guide (91*b*) at an entrance point. The lace (30*a*) travels through the second lower lace guide (91*b*) and then exits the guide (91*b*). After exiting the second lower lace guide (91*b*), the lace (30*a*) extends upwardly and enters the second upper lateral lace guide (93*b*). The lace (30*a*) travels through the second upper lateral lace guide (93*b*) and then exits the guide (93*b*) at an exit point and extends downwardly. The path of the lace (30*a*) can then terminate at a termination plate (56*a*) fastened on the lateral edge (41) in the forefoot region (21). In this version, there are two strands of laces (30*a*, 30*b*). The lace (30*a*) extends along the lateral side (41) of the shoe upper and the lace (30*b*) extends along the medial side (38) of the shoe upper (12); and the laces (30*a*, 30*b*) do not connect. However, the system still provides good closure around the foot and gives a comfortable and smooth fit. In this version, there are two lace strands (30*a*, 30*b*). Both lace strands (30*a*, 30*b*) extend from the same lace tightening assembly (89). In other examples, as described below, the lace can extend along the lateral side and the lace extending along the medial side can connect. That is, there is a single lace running along the lateral and medial sides and forming a continuous loop. For example, the laces can connect via a forefoot connector thread guide (97) as shown in FIGS. 22-25 and discussed below.

The pathway of lace strand (30*a*) along the lateral side (41) of the shoe is described above. In the pathway of the second lace strand (30*b*) along the medial side (38), the lace extends from the lace tightening assembly (89) in the heel region, is threaded through a medial lace channel (52*b*) and as it exits the channel through the eyelet (54), it enters the first lower medial lace guide (91*d*) and then exits the guide (91*d*). After exiting the first lower medial lace guide (91*d*), the lace (30*b*) extends upwardly until it enters the first upper medial lace guide (93*d*) at an entrance point and then exits the guide (93*d*). After the lace (30*a*) exits the first upper medial lace guide (93*d*), it passes downwardly and enters the second lower medial lace guide (91*c*) at an entrance point. The lace (30*b*) travels through the second lower lace guide (91*c*) and then exits the guide (91*c*). After exiting the second lower lace guide (91*c*), the lace (30*b*) extends upwardly and enters the second upper medial lace guide (93*c*). The lace (30*b*) travels through the second upper medial lace guide (93*c*) and then exits the guide (93*b*) at an exit point and extends downwardly. The path of the lace (30*b*) can then terminate at a termination plate (56*b*) fastened on the medial edge (38) in the forefoot region (21). Thus, one lace strand (30*a*) extends along the lateral side (41), and the other lace strand (30*b*) extends along the medial side (38). The respective pathways of the lace strands (30*a*, 30*b*) end at the termination plates (56*a*, 56*b*) on the lateral and medial sides (41, 38) of the shoe upper.

In other versions, the lace (30) passes downwardly through the second upper lateral lace guide (93*b*) and then is threaded through a channel (not shown) running between the upper (12) and midsole (14). The lace (30) passes through this channel and then runs up along the medial side (38) of the shoe upper. Thus, the same lace (30) is threaded through the upper medial lace guides (93*c*, 93*d*) and the lower medial lace guides (91*c*, 91*d*). The lace (30) is passed through the second lower medial lace guide (91*d*) and then is threaded through the medial lace channel (52*b*) and passes back to the lace tightening assembly (89). Thus, in this example, the lace (30) forms a continuous loop so that the lace extends along both the lateral and medial sides and around the heel region of the shoe upper (12).

Turning to FIGS. 22-25, in an eighth embodiment, the shoe upper (12) has the same shoe construction as the shoe upper shown in FIGS. 18-21, with the following additional elements: i) a third lower lateral lace guide (95) located on the lateral side of the upper; ii) a third lower medial lace guide (96) located on the medial side of the upper; and iii) a forefoot connector thread guide (97) attached to the forefoot region of the upper. In this embodiment, the lace (30) forms a continuous loop so that the lace extends along both the lateral and medial sides and around the heel region of the shoe upper (12).

The lace (30) extends from the lace tightening assembly (89) in the heel region, is threaded through a lateral lace channel (52) and as it exits the channel, it enters the first lower lace guide (91*a*) and then exits the guide (91*a*) at an exit point. After exiting the first lower lateral lace guide (91*a*), the lace (30) extends upwardly until it enters the first upper lateral lace guide (93*a*) at an entrance point and exits the guide (93*a*). After the lace (30) exits the first upper lateral lace guide (93*a*) at the exit point, it passes downwardly and enters the second lower lateral lace guide (91*b*) at an entrance point. The lace (30) travels through the second lower lace guide (91*b*) and then exits the guide (91*b*) at an exit point. After exiting the second lower lace guide (91*b*), the lace (30) extends upwardly and enters the second upper lateral lace guide (93*b*). The lace (30) travels through the second upper lateral lace guide (93*b*) and then exits the guide (93*b*) at an exit point and extends downwardly. The lace (30) is then threaded through the third lower lace guide (95) on the lateral side. After exiting the third lower lace guide (95), the lace (30) extends upwardly and is threaded through the forefoot connector thread guide (97) and over to the medial side of the upper (12).

Figure 23:
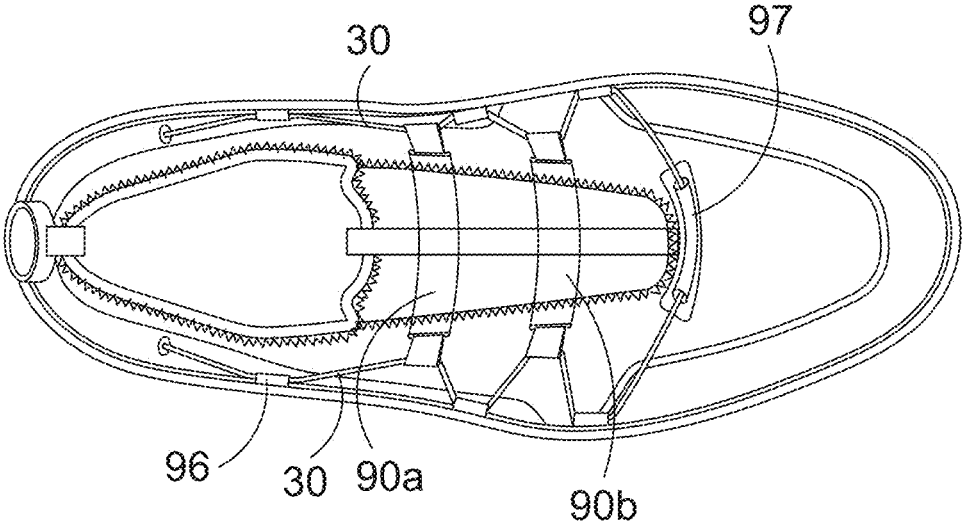
FIG. 23 is a top plan view of the golf shoe shown in FIG. 22.
Figure 24:
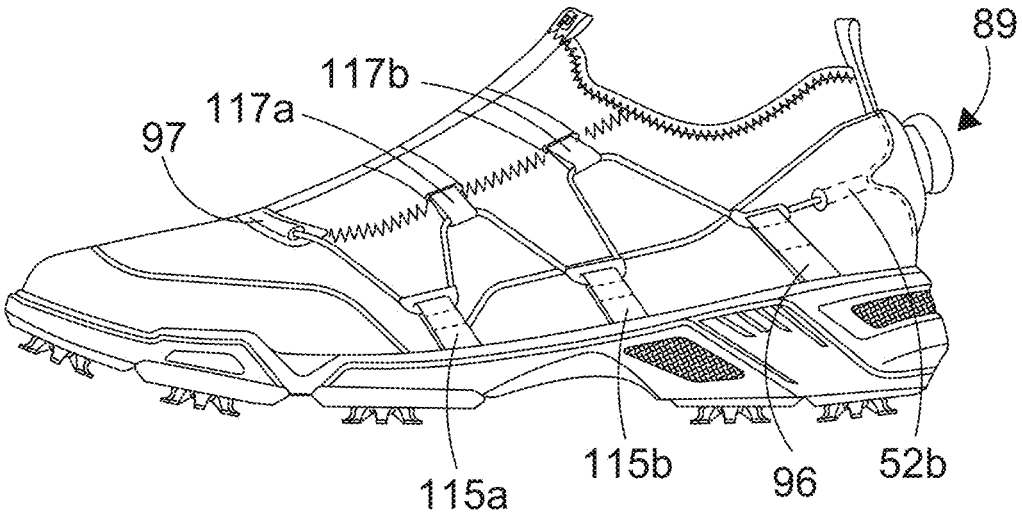
FIG. 24 is a medial side view of the golf shoe shown in FIG. 22.
Figure 25:
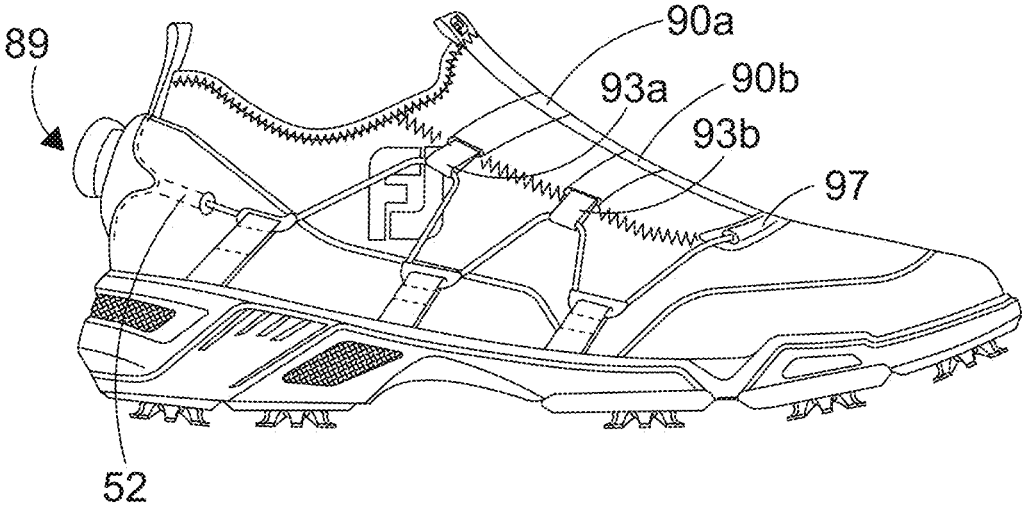
FIG. 25 is a second lateral side view of the golf shoe shown in FIG. 22.
Figure 26:
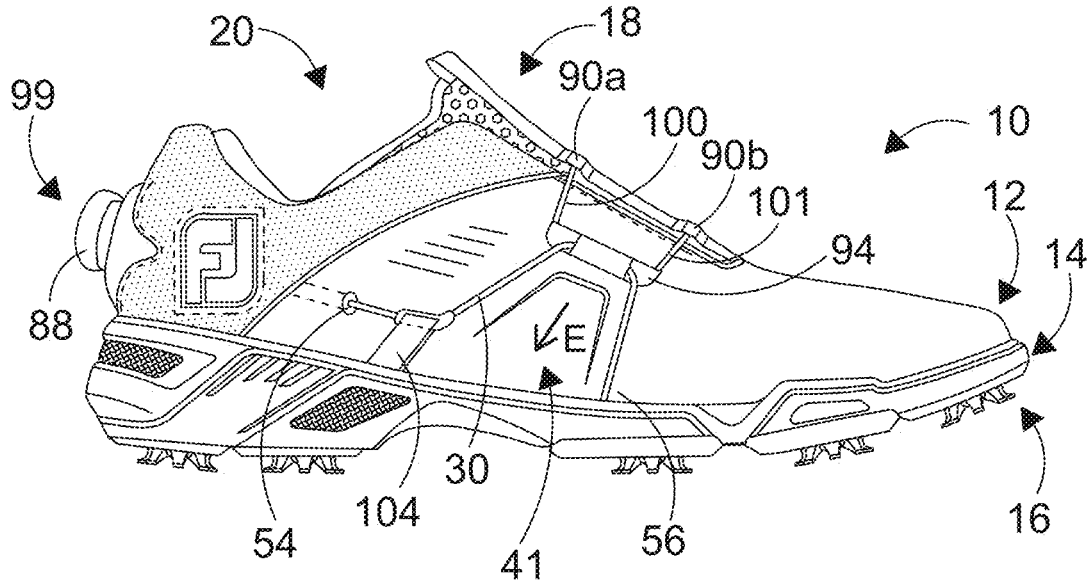
FIG. 26 is a lateral side view of an eighth example of a golf shoe of the present invention showing the upper portion in detail.

As shown in FIGS. 23-24, the same lace (30) then enters the first lower medial lace guide (115*a*) and then exits the guide (115) at an exit point. After exiting the first lower medial lace guide (115*a*), the lace (30) extends upwardly until it enters the first upper medial lace guide (117*a*) at an entrance point and exits the guide (117*a*). After the lace (30) exits the first upper medial lace guide (117*a*) at the exit point, it passes downwardly and enters the second lower medial lace guide (115*b*) at an entrance point. The lace (30) travels through the second lower lace guide (115*b*) and then exits the guide (115*b*) at an exit point. After exiting the second lower medial lace guide (115*b*), the lace (30) extends upwardly and enters the second upper medial lace guide (117*b*). The lace (30) travels through the second upper medial lace guide (117*b*) and then exits the guide (117*b*) at an exit point and extends downwardly. The lace (30) is passed through the third lower medial lace guide (96) and then is threaded through the medial lace channel (52*b*) and passes back to the lace tightening assembly (89). Thus, in this example, the lace (30) forms a continuous loop so that the lace extends along both the lateral (41) and medial (38) sides and around the heel region of the shoe upper (12).

In a ninth embodiment, as shown in FIGS. 26-29, there is a first (lateral) upper connector thread guide (94) positioned on the lateral side of the shoe upper. In FIGS. 26-29, the first (lateral) upper connector thread guide (94) is coupled to the second (medial) upper connector thread guide (107) as discussed further below. The lace (30) extends from a lace tightening assembly (99) in the heel region and exits a trumpet or eyelet guide (54). The lace (30) then enters the lower lateral lace guide (104) at an entrance point and exits the guide (104). After the lace (30) exits the lower lateral lace guide (104), it passes upwardly and enters the first (lateral) upper connector thread guide (94) at an entrance point. The lace then travels through the upper connector thread guide (94) and then extends downwardly. The path of the lace (30) can then terminate at a termination plate (56) fastened on the lateral edge (41) in the forefoot region (21).

In this version, there are two lace strands (30*a*, 30*b*). The lace (30*a*) extends along the lateral side (41) of the shoe upper as described above. Meanwhile, the lace (30*b*) extends along the medial side (38) of the shoe upper (12); and the laces (30*a*, 30*b*) do not connect. The pathway of lace strand (30*a*) along the lateral side (41) of the shoe is described above. In the pathway of lace strand (30*b*) along the medial side (38), the lace extends from the lace tightening assembly (99) in the heel region and is threaded through a medial lace channel (52*b*). As the lace (30*b*) exits the channel through the eyelet (54), it enters the lower medial lace guide (113) and then exits the guide (113). After the lace (30*b*) exits the lower medial lace guide (113) at the exit point, it passes upwardly and enters the second (medial) upper connector thread guide (107) at an entrance point. The lace (30*b*) then travels through the upper connector thread guide (107) and then extends downwardly. The path of the lace (30*b*) can then terminate at a termination plate (56) fastened on the medial edge (41) in the forefoot region (21). In this version, there are two separate lace strands (30*a*, 30*b*), but the system still provides good closure around the foot and gives a comfortable and smooth fit. Both lace strands (30*a*, 30*b*) extend from the same lace tightening assembly (99).

In other versions, the lace (30) passes downwardly from the first (lateral) upper connector thread guide (94) and then it can pass through a channel (not shown) running between the upper and midsole. The lace (30) passes through the channel and then up along the medial side (38) of the shoe upper (12). Thus, in this example, there is a single lace (30) that forms a continuous loop so that the lace (30) extends along both on the lateral and medial sides and around the heel region of the shoe upper. In this version, the same lace (30) extends along both the lateral and medial sides of the shoe upper (12). That is, the lace (30) is threaded through the channel (not shown), passes upwardly, and enters the second (medial) upper connector thread guide (107) at an entrance point. The lace then travels through the second (medial) connector thread guide (107) and then exits and extends downwardly until it passes through a lower medial lace guide (113) on the medial edge of the shoe upper (12). Then, the lace (30) is threaded through the medial lace channel (52*b*) and passes back to the lace tightening assembly (99). Thus, in this example, the same lace (30) forms a continuous loop so that the lace extends along both the lateral and medial sides of the shoe upper (12).

The first (lateral) and second (medial) upper connector thread guides (94, 107) can be coupled to each other by a wide variety of fastening means including, but not limited to, molded plastics, metal wires (100, 101), carbon fiber, carbon fiber composites, fabrics, webbings, fibers and other lacing systems. In other examples, if a bootie (83) is used in the instep region (18), the connector thread guides (94, 107) can go inside of the bootie member.

Figure 27:
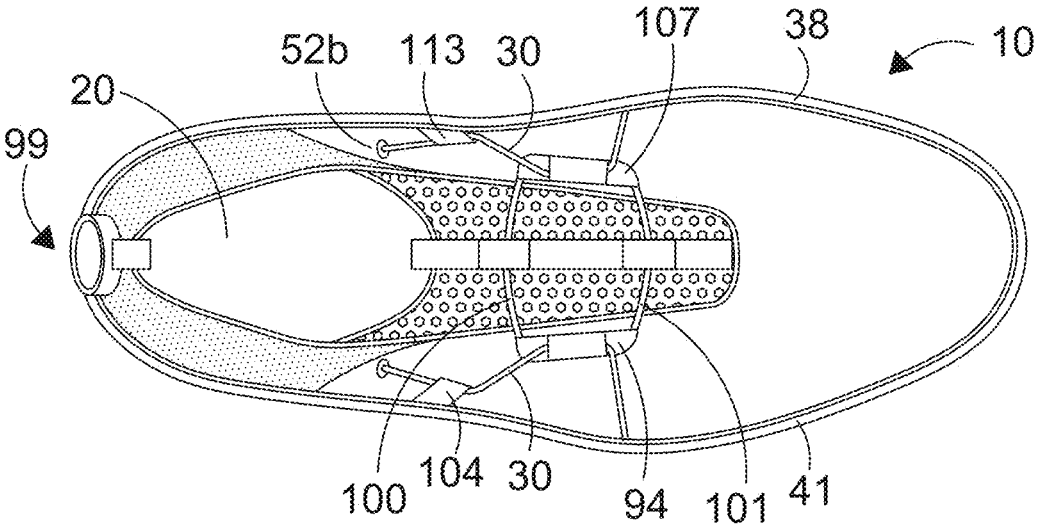
FIG. 27 is a top plan view of the golf shoe shown in FIG. 26.
Figure 28:
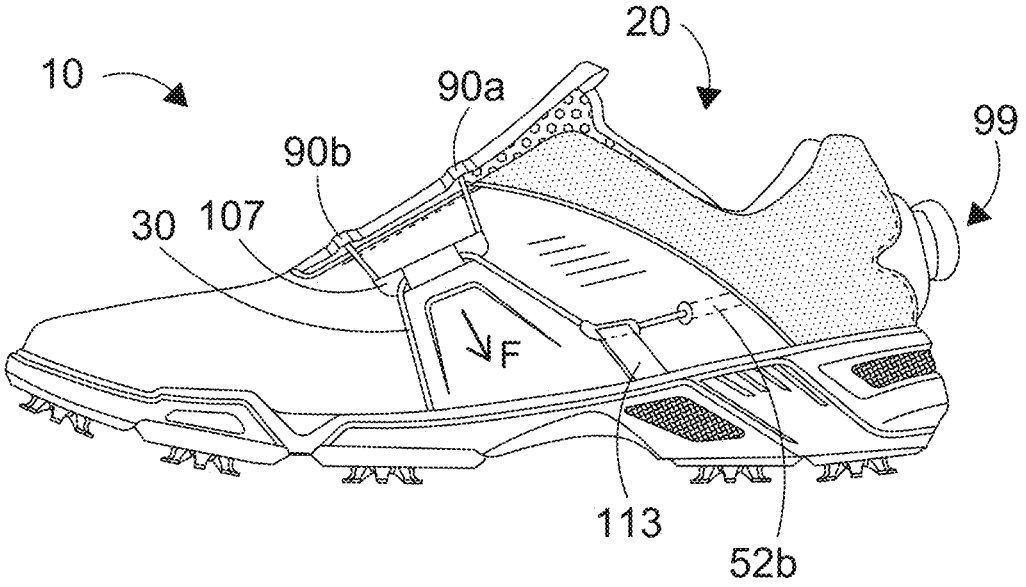
FIG. 28 is a medial side view of the golf shoe shown in FIG. 26.
Figure 29:
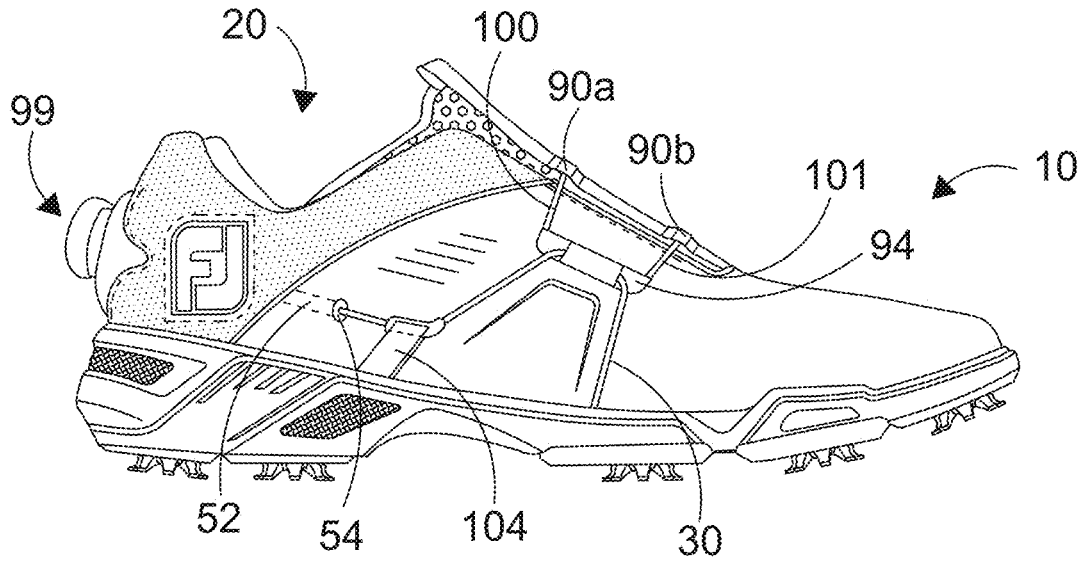
FIG. 29 is a second lateral side view of the golf shoe shown in FIG. 26.

In this embodiment, the lace tightening assembly (99) is located on the heel region of the upper (12). As shown in FIGS. 27 and 28 and discussed above, the lace tightening assembly (99) can include a dial (88) that covers a spool (not shown) positioned within a housing. In one embodiment, the dial (88) is first pushed inwardly to engage the lace tightening system (99). The dial (88) is then rotated in a clockwise direction to tighten the lace (30). As the lace (30) is tightened, the first upper (lateral side) connector thread guide (99) is pulled in a downward direction as represented by Arrow E. The second upper (medial side) connector thread guide (107) is pulled in a downward direction as represented by Arrow F. To loosen the lace (30), the dial (88) is rotated in a counter-clockwise direction. In this manner, the tension on the lace (30) can be adjusted. The tension can be incrementally increased or decreased. The dial (88) may be pulled-out for a quick release of the lace tightening system (99) and loosening of the lace (30).

In a tenth embodiment, as shown in FIGS. 30-33, there are two sections of the power shroud (100)—an upper section (111) and a lower section (112). The power shroud (100) is an integral, unitary structure with an upper section (111) and lower section (112). The upper and lower sections (111, 112) can be made of any suitable material including Neoprene™ synthetic rubber for high comfort and a smooth fit. Other comfortable, elastic materials such as knits, spandex, and spandex blends such as, for example, cotton/spandex, nylon/spandex, and polyester/spandex blends can be used. Natural leathers, synthetic leathers, knits, non-woven materials, natural fabrics, and synthetic fabrics also can be used. For example, synthetic textile fabrics made from nylons, polyesters, polyolefins, polyurethanes, rubbers, and combinations thereof can be used. Microfibers and nonwoven materials can be used as well as engineered knit and rolled good fabrics. All of these fiber and fabric structures can be reinforced with different materials. Also, hot-melt thermoplastic polyurethanes (TPUs) can be applied over these structures.

Figure 30:
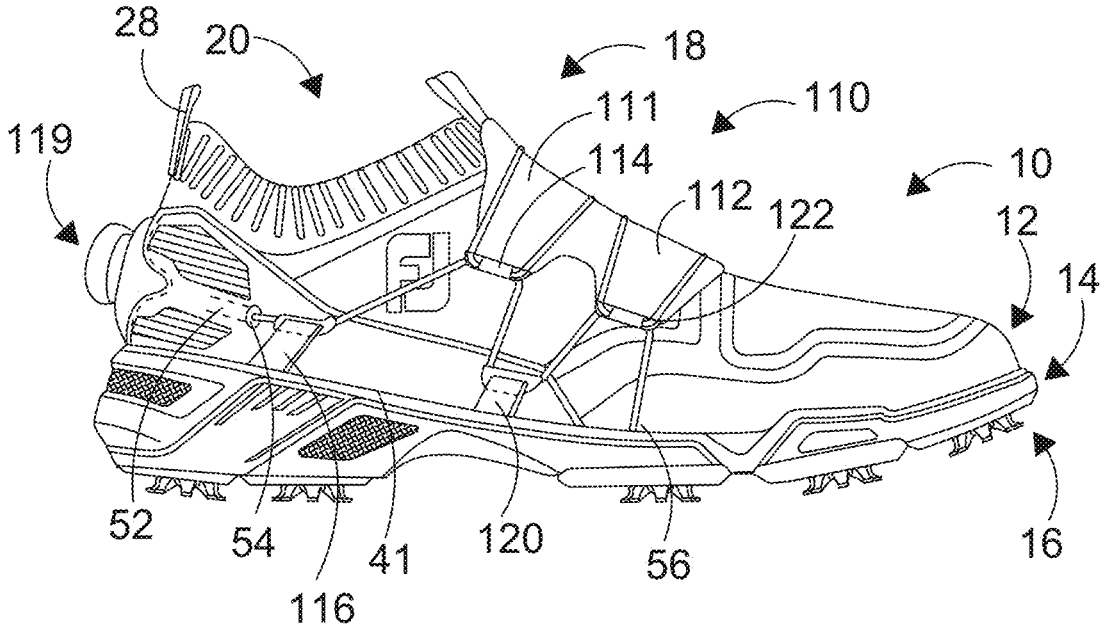
FIG. 30 is a lateral side view of a ninth example of a golf shoe of the present invention showing the upper portion in detail.
Figure 31:
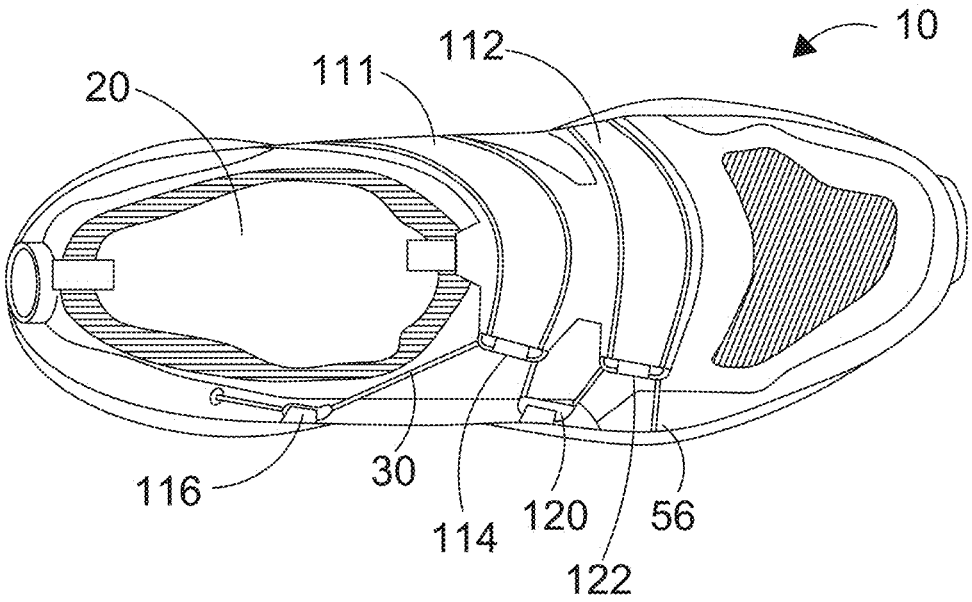
FIG. 31 is a top plan view of the golf shoe shown in FIG. 30.
Figure 32:
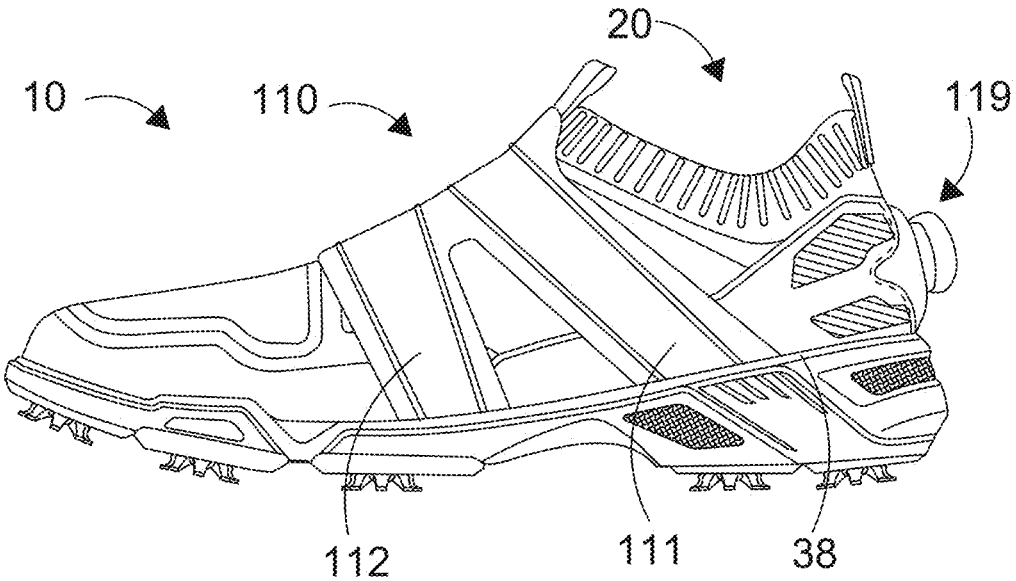
FIG. 32 is a medial side view of the golf shoe shown in FIG. 30.
Figure 33:
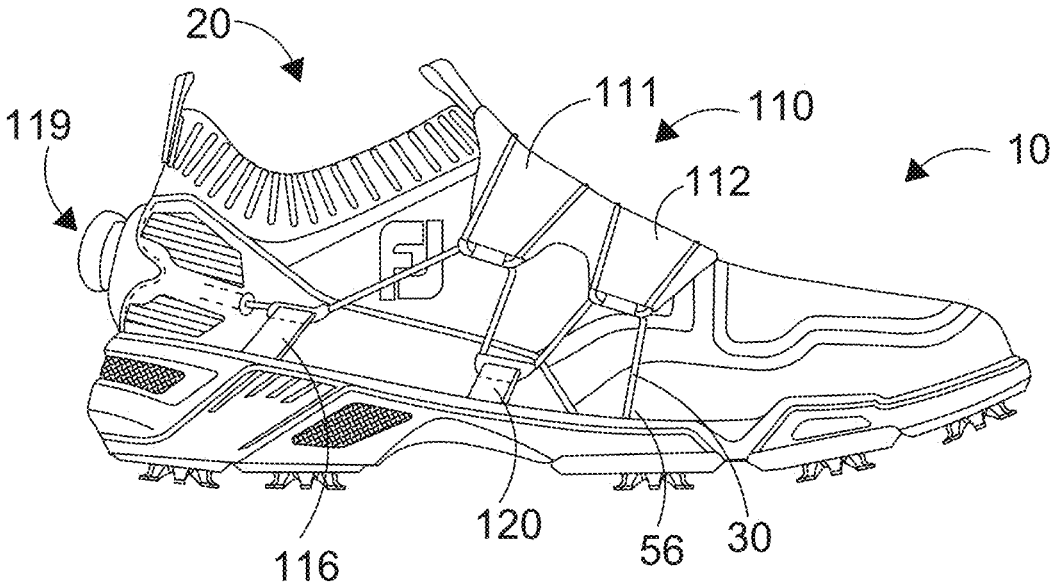
FIG. 33 is a second lateral side view of the golf shoe shown in FIG. 30.
Figure 34:
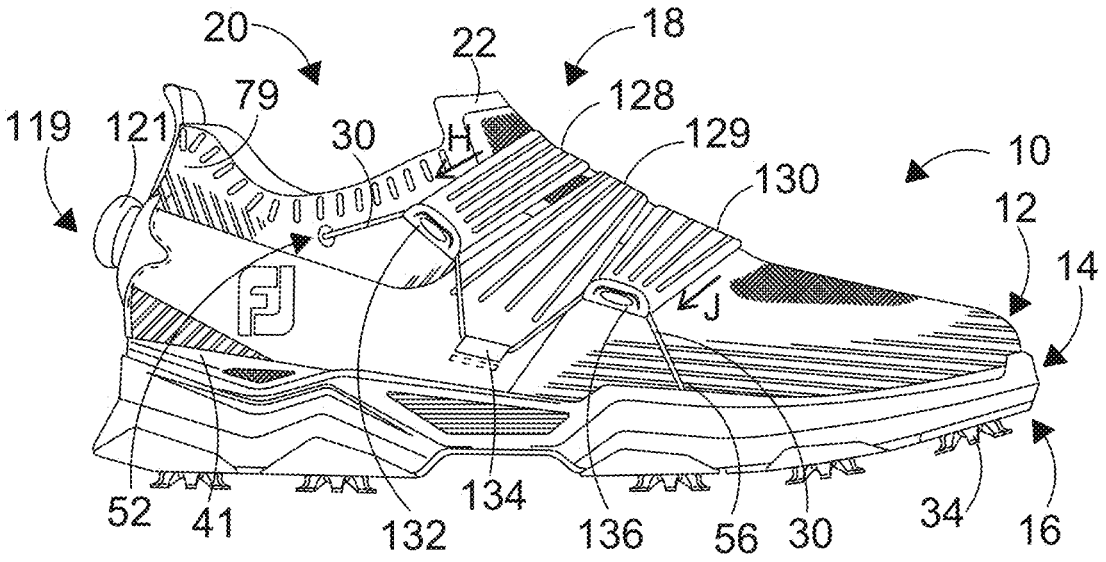
FIG. 34 is a lateral side view of a tenth example of a golf shoe of the present invention showing the upper portion in detail.
Figure 35:
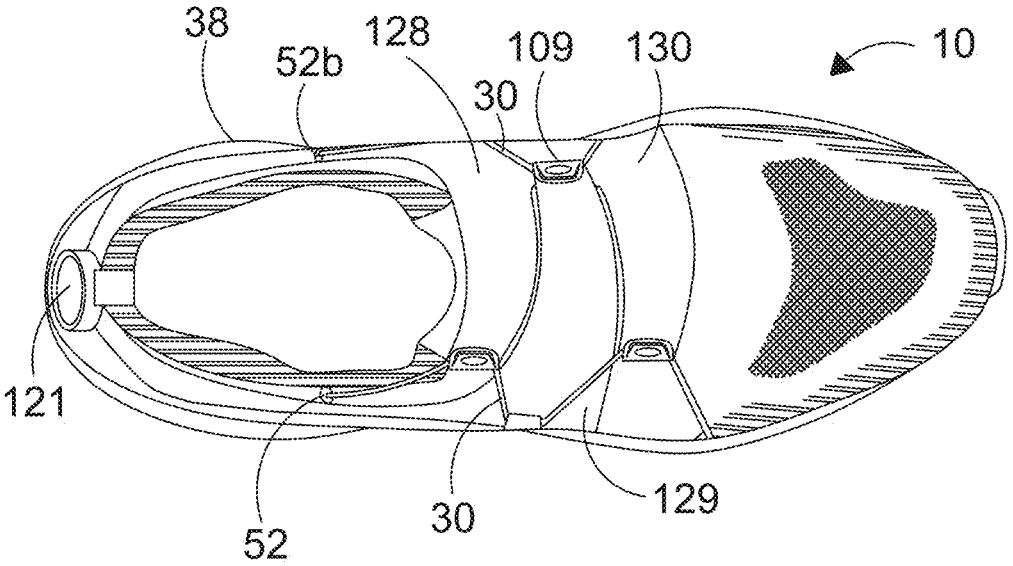
FIG. 35 is a top plan view of the golf shoe shown in FIG. 34.

As shown in FIG. 30, the first and second upper lace guides (114, 122) can be coupled to the upper section (111) of the power shroud (100) by stitching or other means; or the guides (114, 122) can be an integral part of the shroud (100). The lace (30) extends from a lace tightening assembly (119) in the heel region and exits a trumpet or eyelet guide (54). The lace then enters the first lower lace guide (116) at an entrance point and exits the lace guide (116) at an exit point. The first lower lace guide (116) is oriented in an angled position. After the lace (30) exits the first lower lace guide (116) at the exit point, it passes upwardly and enters the first upper lace guide (114) at an entrance point. The lace (30) is threaded through the first upper lace guide (114) and then exits the lace guide (118). After exiting the first upper lace guide (114), the lace extends downwardly to the second lower lace guide (120), where it enters the guide (120) at an entrance point. Then, the lace (30) travels through the second lower lace guide (120) and exits the lace guide (120). The lace (30) then passes upwardly as it enters the second upper lace guide (122). The lace (30) travels through the second upper lace guide (122) and then exits this guide (122). The lace (30) then extends downwardly until its pathway ends at a termination plate (56) fastened on the lateral edge (41) of the upper (12). In the embodiment(s) shown in FIGS. 30-33, a loop between the upper and lower lace guides is formed; however, there are no criss-crossing zones in the loop. As shown in FIGS. 30-33, the lace (30) extends only along one side of the shoe, and yet it still provides an optimal closure system and gives a comfortable fit. The lace (30) can then terminate at a termination plate (56) fastened on the lateral edge (41) in the forefoot region (21).

In other versions, there are two lace strands. One lace extends along the lateral side (41) of the shoe upper (12) as described above. Another lace strand extends along the medial side (38) of the shoe upper (12); and the laces do not connect. Rather, the lace strands terminate at respective termination plates on the lateral and medial sides of the shoe.

Figure 36:
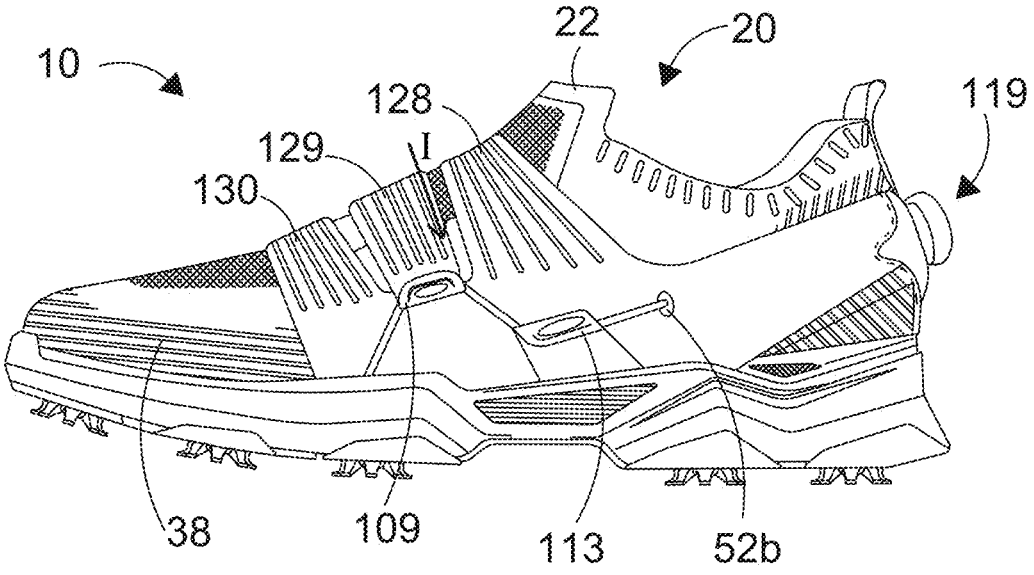
FIG. 36 is a medial side view of the golf shoe shown in FIG. 34.
Figure 37:
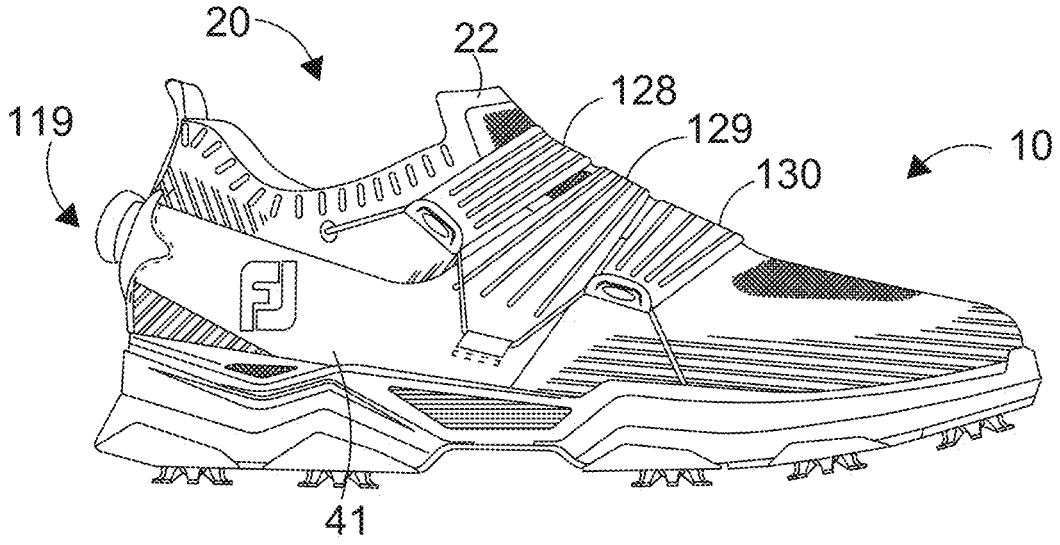
FIG. 37 is a second lateral side view of the golf shoe shown in FIG. 34.
Figure 38:
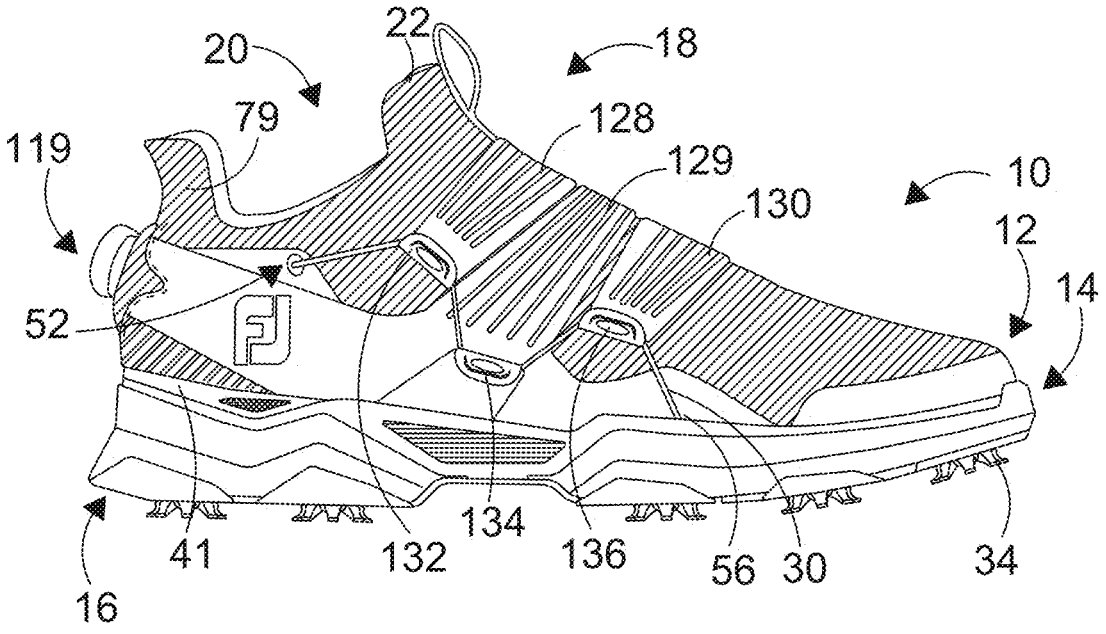
FIG. 38 is a lateral side view of an eleventh example of a golf shoe of the present invention showing the upper portion in detail.
Figure 39:
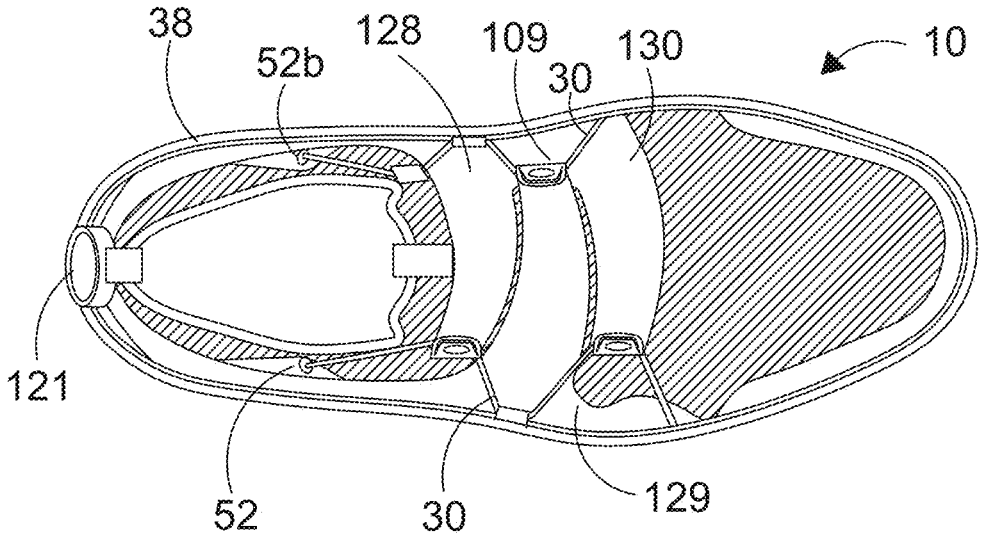
FIG. 39 is a top plan view of the golf shoe shown in FIG. 38.
Figure 40:
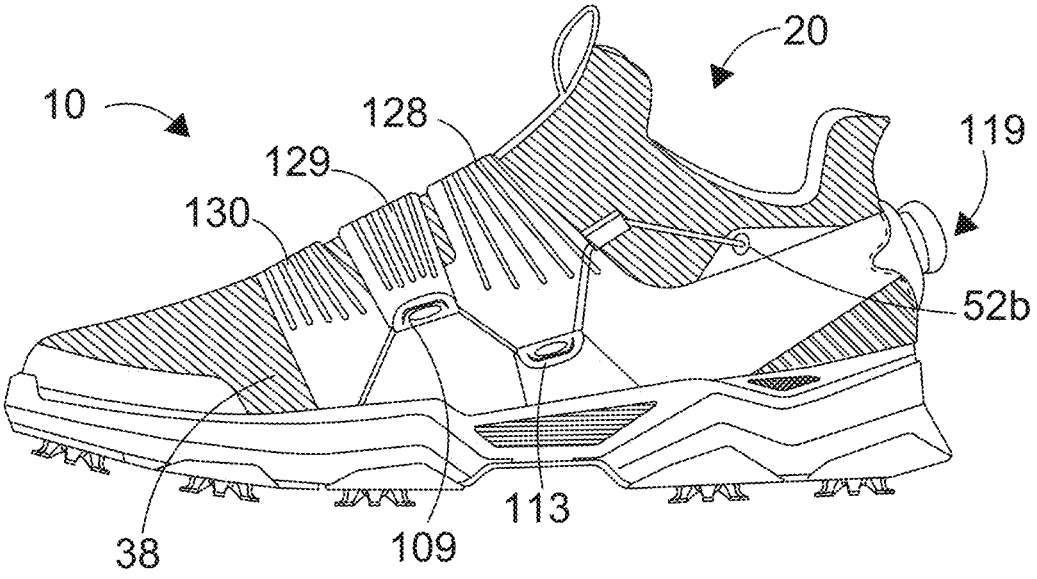
FIG. 40 is a medial side view of the golf shoe shown in FIG. 38.
Figure 41:
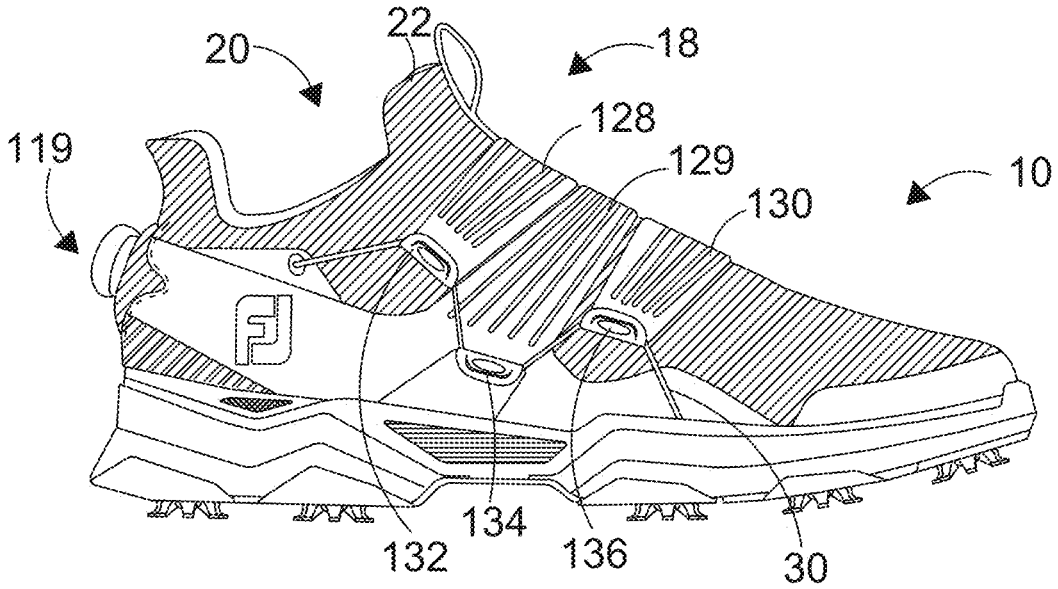
FIG. 41 is a second lateral side view of the golf shoe shown in FIG. 38.
Figure 42:
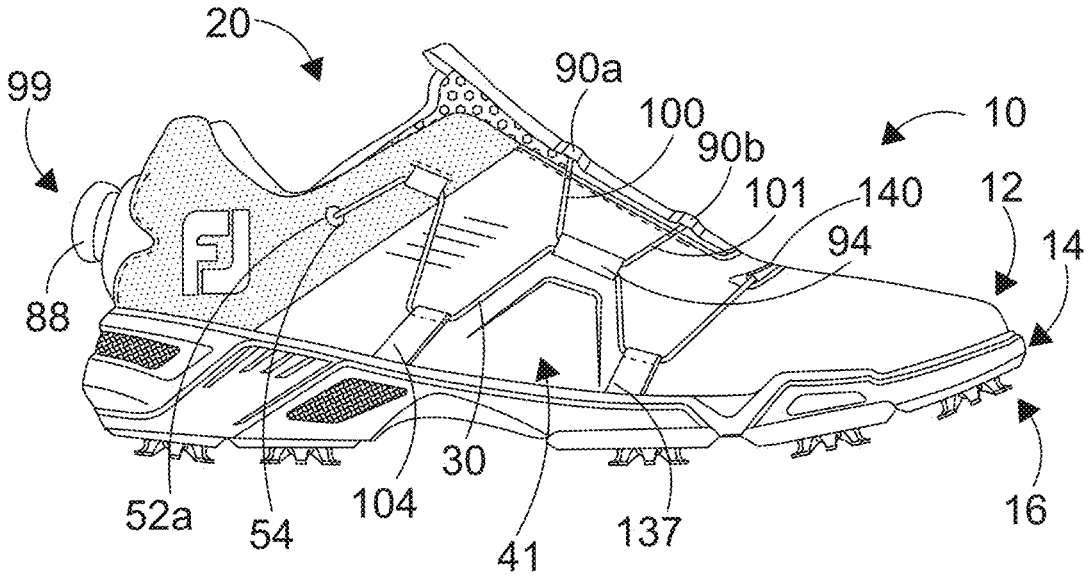
FIG. 42 is a lateral side view of a twelfth example of a golf shoe of the present invention showing the upper portion in detail.

Turning to FIGS. 34-41, in this embodiment of the upper construction, there is a single lace tightening assembly (125) and three power closure straps (128, 129, 130). In this embodiment, the upper portion (12) generally includes an instep region (18) with an opening (20) having a heel collar (79) for inserting a foot. As shown in FIGS. 34-37, in one example, the heel collar (79) has a low profile. In another example, as shown in FIGS. 38-41, the heel collar (79) has a high profile. The pathway of the lace (30) along the medial side of the shoe also can vary as shown in FIGS. 36 and 40.

Referring back to FIG. 34, the lace (30) extends from the lace tightening assembly (119) in the heel region, is threaded through a lateral lace channel (52) and as it exits the channel, it enters the first upper lace guide (132), which is attached to the first (upper) power closure strap (128), and then exits the guide (132) at an exit point. After exiting the first upper lateral lace guide (132), the lace (30) extends downwardly until it enters the lower lateral lace guide (134), which is attached to the second (middle) power closure strap (129), at an entrance point and then exits the guide (134). After the lace (30) exits the lower lace guide (134), it is threaded upwardly and enters the second upper lateral lace guide (136), which is attached to the third (lower) power closure strap (130). The lace (30) travels through second upper lace guide (136) and then exits the guide (136). The lace (30) then passes downwardly until its pathway ends at a termination plate (56) fastened on the lateral edge (41) of the upper (12).

In this version, there are two lace strands (30*a*, 30*b*). The lace (30*a*) extends along the lateral side (41) of the shoe upper and the lace (30*b*) extends along the medial side (38) of the shoe upper (12); and the laces (30*a*, 30*b*) do not connect. However, the system still provides good closure around the foot and gives a comfortable and smooth fit. The pathway of lace strand (30*a*) along the lateral side (41) of the shoe is described above. In the pathway of lace strand (30*b*) along the medial side (38), the lace extends from the lace tightening assembly (119) in the heel region, is threaded through a medial lace channel (52*b*) and as it exits the channel through the eyelet (54), it enters the lower medial lace guide (113) (FIG. 36). In other examples (as shown in FIG. 40), the lace (30*b*) can enter an upper medial lace guide (124) before entering the lower medial lace guide (113). Then, the lace (30*b*) exits the lace guide (113) and then enters the upper medial lace guide (109) attached to the second (middle) power closure strap (129). The lace (30*b*) then passes downwardly until its pathway ends at a termination plate (56) fastened on the medial edge (38) of the upper (12).

In other versions, the lace (30) passes downwardly and then it can pass through a channel (not shown) running between the upper and midsole. The lace (30) passes through the channel and then up along the medial side (38) of the shoe upper (12). Thus, in this example, the lace (30) forms a continuous loop so that the lace extends both along the lateral and medial sides and around the heel region of the shoe upper. In this version, the same lace (30) extends along the medial side of the shoe upper. That is, the lace (30) passes upwardly and enters the medial upper connector thread guide (109) at an entrance point. The lace then travels through the medial connector thread guide (109) and then extends downwardly until it passes through a second lower lace guide (113) on the medial side (38). Then, the lace (30) is threaded through the medial lace channel (52*b*) and passes back to the lace tightening assembly (119). Thus, in this example, the lace (30) forms a continuous loop so that the lace extends along both the lateral and medial sides and heel region of the shoe upper (12).

As shown in FIGS. 34-41 and discussed above, the lace tightening assembly (119) can include a dial (121) that covers a spool (not shown) positioned within a housing. As the lace (30) is tightened via the lace tightening assembly (119), the upper power closure strap (128) is pulled in a downward direction as represented by Arrow H; the middle power closure strap (129) is pulled in a downward direction as represented by Arrow I; and lower power closure strap (130) is pulled in a downward direction as represented by Arrow J. The lace guides have low friction and this ensures that the lace (30) can be pulled through the guides smoothly and tightly. To loosen the lace (30), the dial (121) is rotated in a counter-clockwise direction. In this manner, the tension on the lace (30) can be adjusted. The tension can be incrementally increased or decreased. The dial (121) may be pulled-out for a quick release of the lace tightening system (110) and loosening of the lace (30). Thus, the lace (30) forms a continuous loop so that the lace extends along the lateral and medial sides and around the heel region of the shoe upper (12). Adjusting the lace (30) provides a substantially uniform application of force against the shoe upper. There is a uniform tightening of the shoe against a wearer's foot. This helps prevent pressure points on the wearer's foot.

In still another embodiment, as shown in FIGS. 42-45, the shoe upper (12) has the same shoe construction as the shoe upper shown in FIGS. 26-29, with the following modifications: i) the first (lateral) upper connector thread guide (94) positioned on the lateral side of the shoe upper is made of webbing instead of a plastic material; ii) there is an upper lace guide (135) adjacent to the lateral lace channel (52*a*); iii) there are two lower lace guides (104, 137); and iv) there is a forefoot connector thread guide (140) attached to the forefoot region of the upper. In this embodiment, the lace (30) forms a continuous loop so that the lace extends along the lateral and medial sides and around the heel region of the shoe upper (12).

In FIGS. 42-45, the first (lateral) upper connector thread guide (94) is coupled to the second (medial) upper connector thread guide (107) as discussed further below. The lace (30) extends from a lace tightening assembly (99) in the heel region and exits the lateral lace channel (52*a*) through a trumpet or eyelet guide (54). The lace (30) then enters the first upper lace guide (135) at an entrance point and exits the guide (135). After the lace (30) exits the first upper lace guide (135), it extends downwardly and enters the first lower lace guide (104) and then exits the guide (104) at the exit point. Then, the lace (30) passes upwardly and enters the first (lateral) upper connector thread guide (94) at an entrance point. The lace then travels through the upper connector thread guide (94) and extends downwardly to the second lower lace guide (137).

Figure 43:
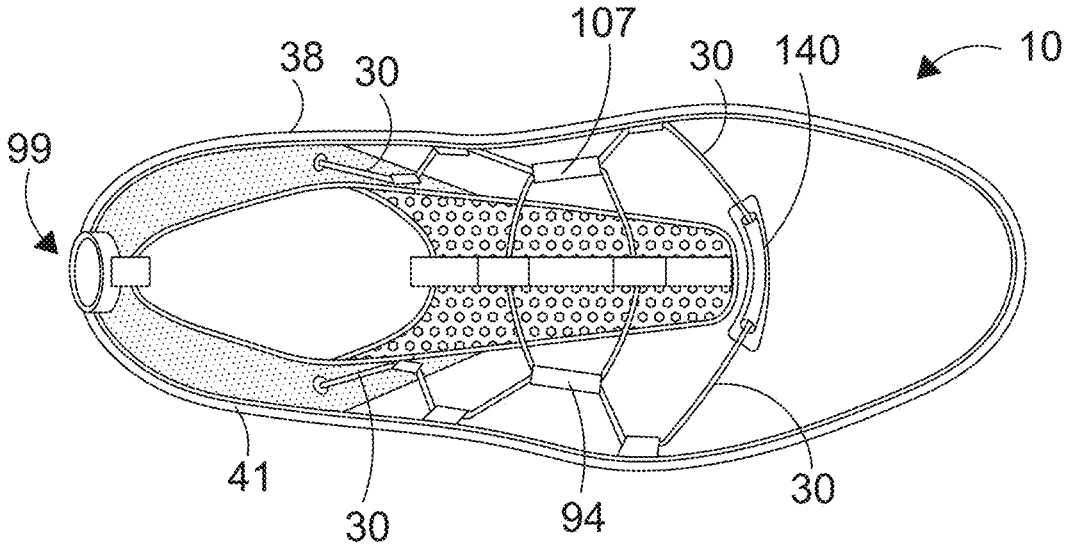
FIG. 43 is a top plan view of the golf shoe shown in FIG. 42.
Figure 44:
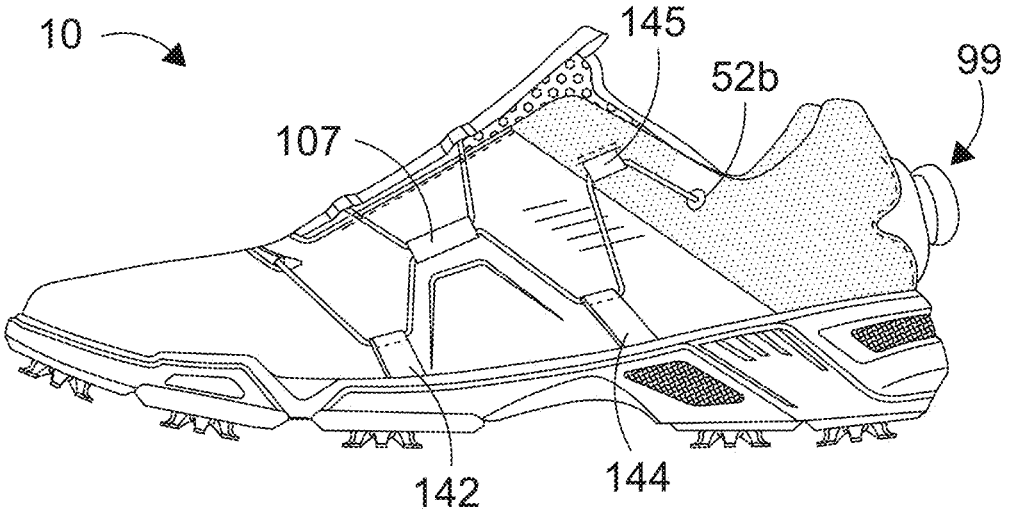
FIG. 44 is a medial side view of the golf shoe shown in FIG. 42.
Figure 45:
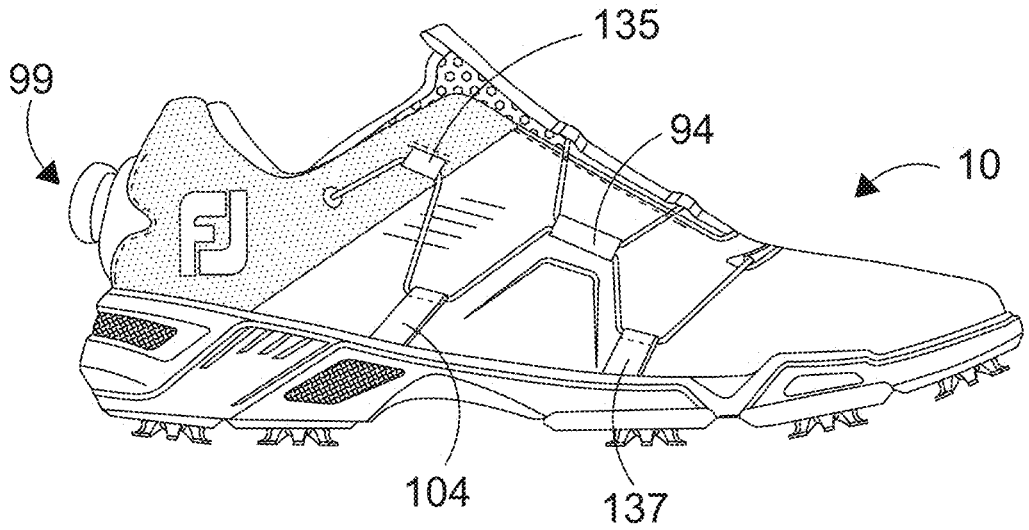
FIG. 45 is a second lateral side view of the golf shoe shown in FIG. 42.

After exiting the second lower lace guide (137), the lace (30) extends upwardly and is threaded through the forefoot connector thread guide (140) and over to the medial side (38) of the upper (12). As shown in FIGS. 43-44, the same lace (30) then enters the first lower medial lace guide (142) and then exits the guide (142) at an exit point. After exiting the first lower medial lace guide (142), the lace (30) extends upwardly until it enters the medial upper connector thread guide (107). After the lace (30) exits the upper medial thread guide (107) at the exit point, it passes downwardly and enters the second lower medial lace guide (144) at an entrance point. The lace (30) travels through the second lower medial lace guide (144) and then exits the guide (144). After exiting the second lower medial lace guide (144), the lace (30) extends upwardly and enters the upper medial lace guide (145). The lace (30) then is threaded through the medial lace channel (52*b*) and passes back to the lace tightening assembly (99). Thus, in this example, the lace (30) forms a continuous loop so that the lace extends along the lateral and medial sides and around the heel region of the shoe upper (12).

In this example, the first (lateral) and second (medial) upper connector thread guides (94, 107) are made of webbing and can be coupled to each other by a wide variety of fastening means including, but not limited to, molded plastics, metal wires (100, 101), carbon fiber, carbon fiber composites, fabrics, webbings, fibers and other lacing systems.

Figure 46:
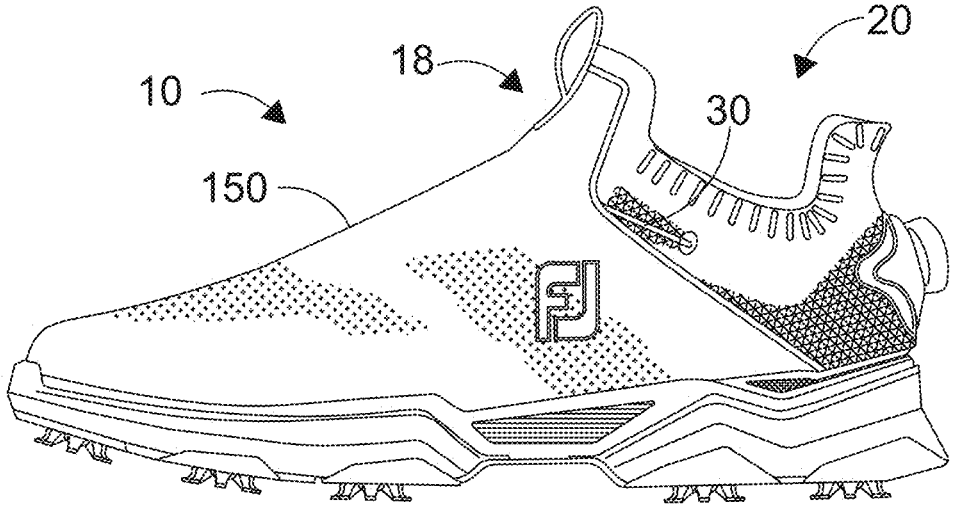
FIG. 46 is a lateral side view of a thirteenth example of a golf shoe of the present invention showing the upper portion in detail.

All of the different embodiments of the golf shoes (10) of this invention as described above have a lace tightening system helps control the motion of the foot by applying forces over the instep region and on the medial and lateral sides and heel regions. Referring to FIG. 46, it is further recognized that this lace tightening system including power shrouds and lace guides as described above can be covered with a shoe covering (150). This shoe covering (150) helps provide an aesthetically-pleasing and fashionable look to the shoe.

Figure 47:
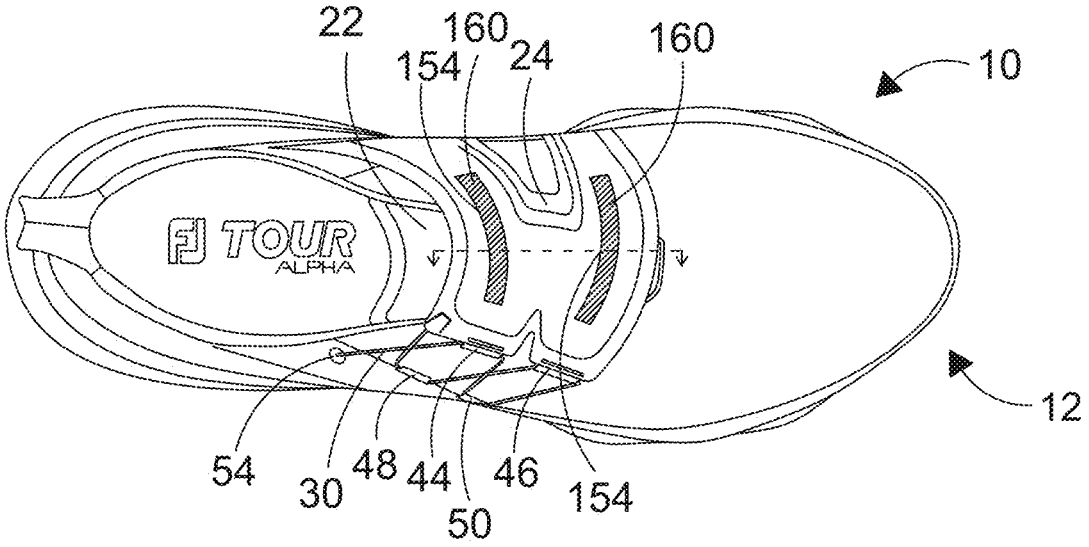
FIG. 47 is a top plan view of a golf shoe according to another embodiment of the invention.
Figure 48:
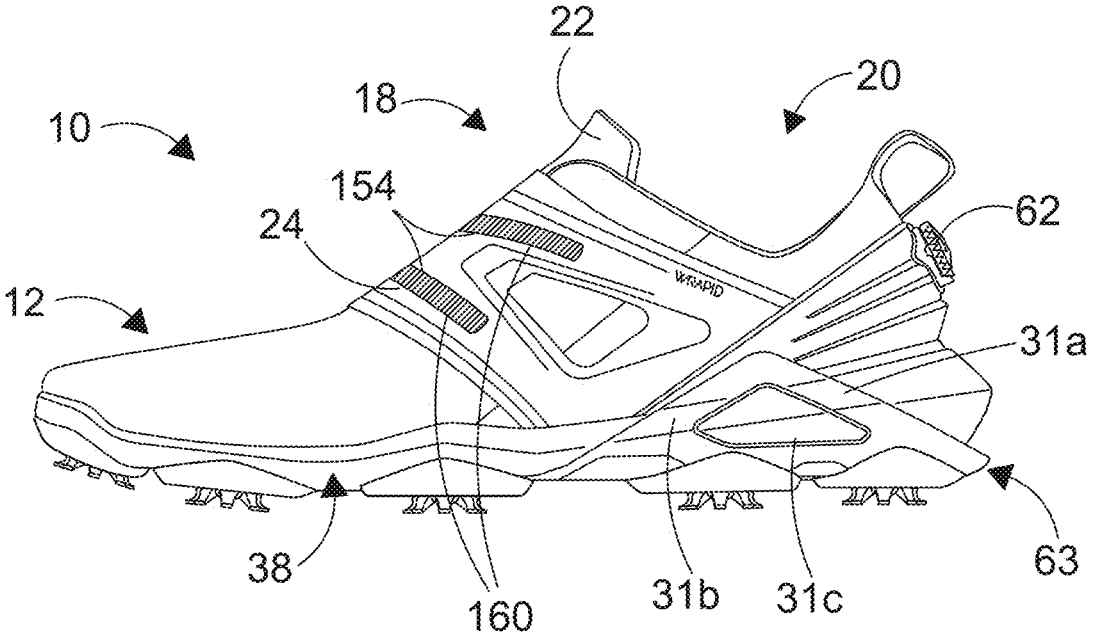
FIG. 48 is a medial side view of the golf shoe shown in FIG. 47.
Figure 49:
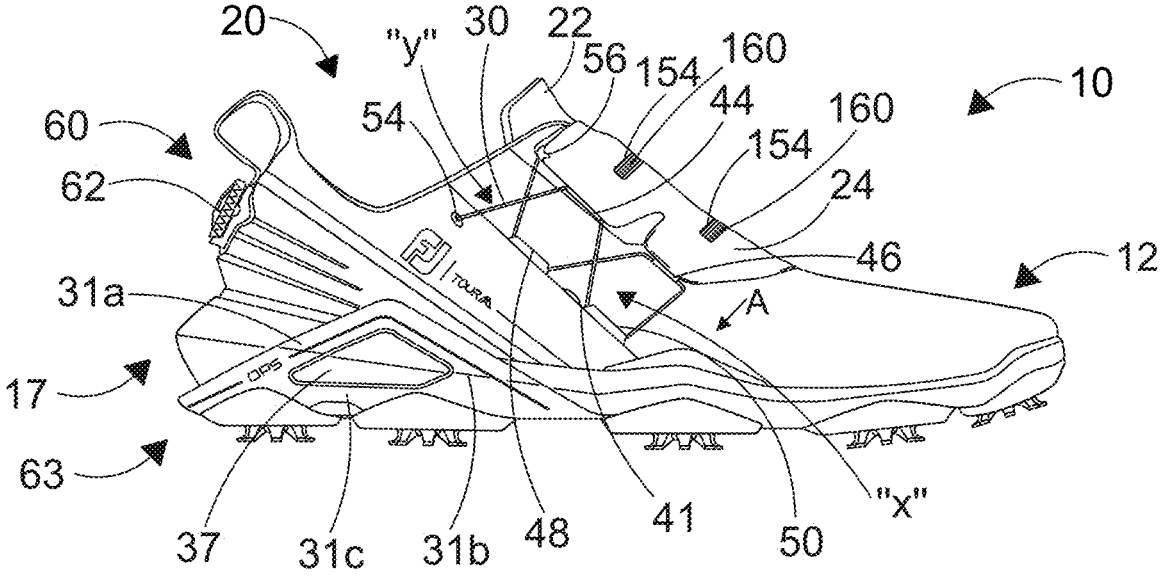
FIG. 49 is a lateral side view of the golf shoe shown in FIG. 47.

As shown in FIGS. 47-49 an alternative embodiment of the power shroud (24) is illustrated. It will be appreciated that the shoe construction embodiment shown is similar to the construction described above with regard to the embodiments shown in FIGS. 1-10 and 47-49. Alternatively, the shoe construction may be according to any of the constructions discussed in this application. Referring now to FIGS. 47-49, in another embodiment, the shoe upper (12) has a unique design with a skeletal frame having an "A Frame-shaped" structure (63) extending upwardly from the midsole (14) that provides additional stability and support as described previously with regard to FIGS. 9 and 10. In this embodiment, the lace (30) is threaded through the upper and lower lace guides (44, 46, 48, 50) in the same manner as illustrated and described previously with regard to FIGS. 1-4 and 9-10. It will be appreciated that the lace guides (44, 46, 48, 50) may be attached to the power shroud (24) by stitching, adhesives, or any other suitable fastening means. More particularly, the upper lace guides (44, 46), which are attached to the power shroud (24), are oriented in an angled position. The lace (30) extends from a lace tightening assembly (60) in the heel region (17) and exits a trumpet or eyelet guide (54). The lace (30) then enters the first upper lace guide (44) at an entrance point and exits the lace guide (44). After the lace (30) exits the first upper lace guide (44) at the exit point, it passes downwardly and enters the second lower lace guide (50), which is attached to the lateral side (41) of the upper. The lace (30) travels through the second lower lace guide (50) and then exits the lace guide (50) at an exit point. After exiting the second lower lace guide (50), the lace is threaded upwardly to the second upper lace guide (46), where it enters the lace guide (46) at an entrance point. Then, the lace (30) travels through the second upper lace guide (46) and exits the lace guide (46). Next, the lace (30) then passes downwardly and crosses over itself for a first time as it enters the first lower lace guide (48), which is attached to lateral side (41) of the upper. As shown in FIG. 49, this area can be referred to as the first criss-crossing zone ("X"). The lace (30) travels through the first lower lace guide (48) and then exits this lace guide (48) at an exit point. The lace (30) then extends upwardly and crosses over itself for a second time until its pathway ends at a termination plate (56) attached to the power shroud (24). This area can be referred to as the second criss-crossing zone ("Y"). As shown in FIGS. 47-49, the lace (30) extends only along one side of the shoe, and yet it still provides an optimal closure system and gives a comfortable fit. There is only one strand of lace. That is, a single lace (30) is shown in FIGS. 47-49 extending along only the lateral side of the shoe upper (12). In other examples, the lace can be threaded so that it only extends along the medial side of the upper (12).

As shown in FIGS. 47-49 in this embodiment the power shroud (24) has first and second window openings (154) provided extending longitudinally in the power shroud (24) such that they extend across the midfoot region when the power shroud (24) is tightened across shoe (10) to secure the wearer's foot within the shoe. The first and second window openings (154) are provided with a fiber-reinforced composite strip (160) that fills and shows through the window opening (154). It will be appreciated that the fiber-reinforced composite strip (160) may be provided such that each window opening (154) has a separate fiber-reinforced composite strip (160) that fills and shows through the window opening (154). In one construction, the window openings are through openings provided in the power shroud (24). Preferably, at least one fiber-reinforced composite strip (160) is secured to a back surface of the power shroud (24) so that it fills and shows through the at least one window opening (154). Alternatively, a single fiber-reinforced composite strip (160) may be secured on the back surface of the power shroud (24) showing though the two or more window openings (154).

In an alternate construction, the power shroud (24) may be made of two layers of material, an outer and inner layer. The outer layer of material may be provided with the window opening (154) with the fiber-reinforced composite strip (160) secured between the layers of the power shroud (24) and showing through the window opening (154). The fiber-reinforced composite strip may be provided as either a fiber-reinforced composite strip (160) for each window opening (154) or a single fiber-reinforced composite strip (160) may be provided to fill all the window openings (154).

The fiber-reinforced composite strip (160) comprises a binding matrix (resin) and reinforcing fiber. The binding polymer can be a thermoset material such as epoxy or rubber. Thermoplastic resins such as polyesters, polyolefins, nylons, and polyurethanes also can be used. Preferably, carbon fiber such as graphite is used as the reinforcing fibers. Other fibers such as aramids (for example, Kevlar™), aluminum, or glass fibers can be used in addition to or in place of the carbon fibers. The fiber-reinforced composite strip (160) can be manufactured using standard techniques, where the reinforcing fibers are impregnated with a resinous material, such as epoxy. This resin is used as a matrix to bind the reinforcement fibers. These impregnated materials may be laid-up to form a laminate structure such as a strip which is cured at high temperatures to solidify the composite material. The resulting fiber-reinforced composite strip is light-weight and has excellent mechanical properties such as high stiffness, high tensile strength, and a low weight-to-strength ratio. As discussed above, the power shroud (24) may have at least one window opening (154) with the fiber-reinforced composite strip (160) secured within the window opening. Alternatively, the power shroud (24) may have a sandwich-like or layered construction, wherein the fiber-reinforced composite strip (160) is disposed between the layers and fitted to be provided within the window opening (154) in the outer layer. It will be appreciated that the fiber-reinforced composite strip (160) may be secured to the power shroud (24) by any suitable method, including adhesives, stitching or any other suitable fastening means. The fiber-reinforced composite strip (160) provides a light-weight material that stiffens the power shroud (24) improving the stability and fit of the shoe. It will be appreciated that the power shroud (24) is pulled over the instep region (18) and towards the lateral side (41) when the lace (30) is tightened via the lace tightening system (60) as described previously. By providing the fiber-reinforced composite strip (160) extending longitudinally across the power shroud (24) from the instep region (18) towards the lateral side (41) in the mid-foot region (23), the golfer has better stability and balance when making a shot.

Figure 50:
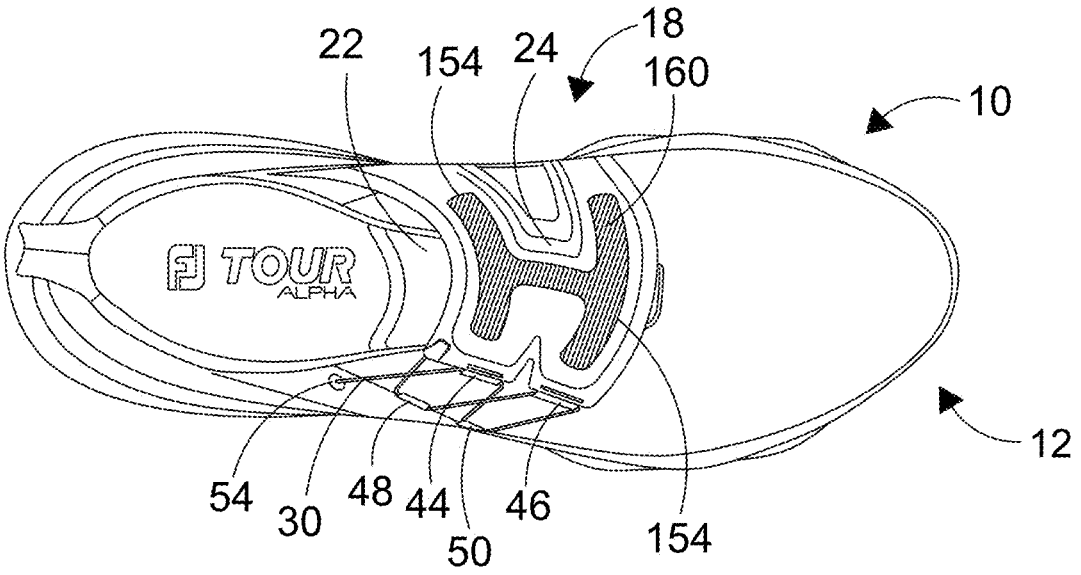
FIG. 50 is a top plan view of a golf shoe according to another embodiment of the invention.
Figure 51:
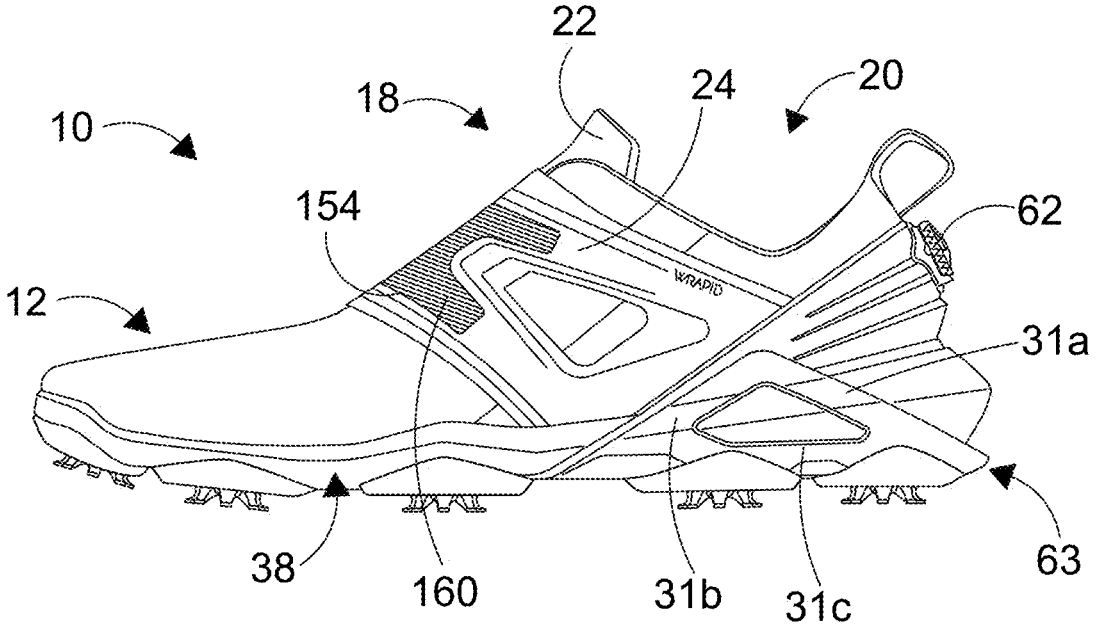
FIG. 51 is a medial side view of the golf shoe shown in FIG. 50.
Figure 52:
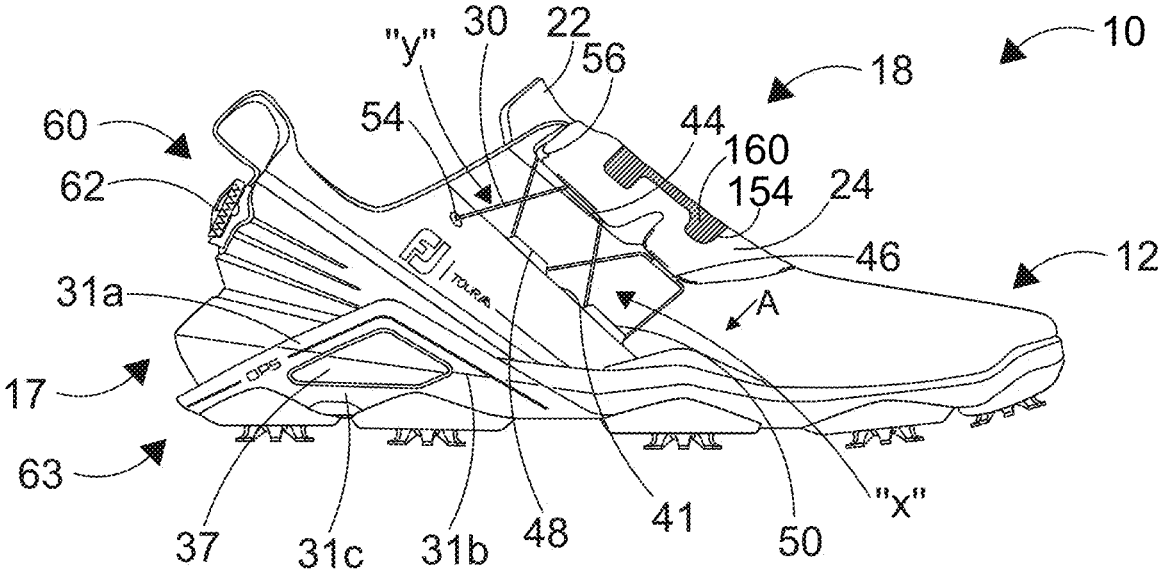
FIG. 52 is a lateral side view of the golf shoe shown in FIG. 50.

As shown in FIGS. 50-52 an alternative embodiment of the power shroud (24) is illustrated. It will be appreciated that the shoe construction embodiment shown is similar to the construction described above with regard to the embodiments shown in FIGS. 1-10 and 47-49. Alternatively, the shoe construction may be according to any of the constructions discussed in this application. As shown, the power shroud (24) has a single window opening (154) in the shape of an "H" provided extending longitudinally in the power shroud (24) such that two substantially parallel openings extend across the midfoot region connected by a center opening when the power shroud (24) is tightened across the mid-foot region of the shoe (10). The window opening (154) is provided with a fiber-reinforced composite strip (160) filling and showing through the window opening (154). In one construction, the window openings (154) are through openings provided in the power shroud (24). Preferably, at least one fiber-reinforced composite strip (160) is secured to a back surface of the power shroud (24) so that it fills and shows through the at least one window opening (154). It will be appreciated that the fiber-reinforced composite strip (160) may be provided in the same "H" shape to fill the window opening (154), or the fiber-reinforced composite strip may be provided as a larger piece that fills the window opening (154) such as a large rectangle.

In an alternate construction for FIGS. 50-52, the power shroud (24) may be made of two layers of material, an outer and inner layer. The outer layer of material may be provided with the window opening (154) in the shape of an "H" with the fiber-reinforced composite strip (160) provided between the layers of the power shroud (24) and showing through the window opening (154). As discussed previously, the single fiber-reinforced composite strip (160) may be provided as the same "H" shape to fill the window opening (154), or the fiber-reinforced composite strip (160) may be provided as a larger piece that fills the window opening (154), for example in the shape of rectangle.

It will also be appreciated that the at least one window opening (154) and/or fiber-reinforced composite strip (160) of the embodiments of FIGS. 47-52 may have any desired shape or size. Preferably, as discussed previously the power shroud (24) has a length (L1) and the at least one window opening (154) and/or fiber-reinforcing composite strip (160) may extend along at least 30% of the length (L1) of the power shroud (24), preferably at least 50% of the length (L1) of the power shroud (24).

Additionally, it will also be appreciated that the fiber-reinforced carbon strip (160) of the embodiments of FIGS. 47-52 may be provided covering the window opening (154) by being secured to the outside surface of the power shroud (24), or the fiber-reinforced composite strip (160) may be secured to the outer surface of the power shroud (24) with the power shroud (24) having no window openings (154) provided for the fiber-reinforced composite strip (160).

The golf shoes of this invention provide a secure and yet comfortable fit. In one embodiment, the tension in the lace(s) as it passes through the different lace guides is substantially the same. In other embodiments, the tension can vary. Adjusting the lace(s) provides a substantially uniform application of force against the shoe upper. The system of the present invention distributes the lateral, medial, and downward tightening forces uniformly along the length of the foot. The lace guides are evenly pulled across the instep region, thus closing the instep region and drawing the foot down. Thus, there is a uniform tightening of the shoe against a wearer's foot. This helps prevent pressure points on the wearer's foot. The foot is drawn into the heel region and along the lateral and medial regions to provide a secure and comfortable fit.

Furthermore, the lace tightening system of this invention can be incrementally adjusted to tighten or loosen the lace as desired by the wearer. The golf shoes of this invention provide a high level of comfort and stability and are custom-fitting. The lace tightening system can be micro-adjusted to provide an optimum fit for any golfer and any shoe fitting preference. The different embodiments of the golf shoes have both a high level of stability, power, and traction as well as a high level of flexibility. The shoes provide stability, power, and traction so there is no slipping and the golfer can stay balanced as he/she swings the club. At the same time, the shoes have good flexibility so the golfer is able to walk and play the course and engage in other golf activities comfortably.

The shoes of this invention also help provide power and stability to the golfer as they shift their weight during the golf swing. For example, when a golfer is first planting his/her fect before beginning any club swinging motion (that is, when addressing the ball), their weight is evenly distributed between their front and back feet. As the golfer begins their backswing, their weight shifts primarily to their back foot. Significant pressure is applied to the back foot at the beginning of the downswing. Thus, the back foot can be referred to as the driving foot and the front foot can be referred to as the stabilizing foot. As the golfer follows through with their swing and drives the ball, their weight is transferred from the driving foot to the front (stabilizing) foot. During the swinging motion, there is some pivoting at the back and front feet, but this pivoting motion must be controlled. It is important that both the front and back feet do not substantially move or slip when making the shot. The golf shoes of the present invention help prevent this movement and slippage. The golf shoes of this invention help provide stability and support by uniformly distributing the lateral, medial, and downward tightening forces along the length of the foot.

When numerical lower limits and numerical upper limits are set forth herein, it is contemplated that any combination of these values may be used. Other than in the operating examples, or unless otherwise expressly specified, all of the numerical ranges, amounts, values and percentages such as those for amounts of materials and others in the specification may be read as if prefaced by the word "about" even though the term "about" may not expressly appear with the value, amount or range. Accordingly, unless indicated to the contrary, the numerical parameters set forth in the specification and attached claims are approximations that may vary depending upon the desired properties sought to be obtained by the present invention.

It also should be understood the terms, "first", "second", "third", "fourth", "fifth", "sixth", "seventh", "eight", "ninth", "tenth", "eleventh", "twelfth", "top", "bottom", "upper", "lower", "upwardly", "downwardly", "right', "left", "center", "middle", "proximal", "distal", "lateral", "medial", "anterior", "posterior", "forefoot", "mid-foot", and "rear-foot", and the like are arbitrary terms used to refer to one position of an element based on one perspective and should not be construed as limiting the scope of the invention.

All patents, publications, test procedures, and other references cited herein, including priority documents, are fully incorporated by reference to the extent such disclosure is not inconsistent with this invention and for all jurisdictions in which such incorporation is permitted. It is understood that the shoe materials, designs, constructions, and structures; shoe components; and shoe assemblies and sub-assemblies described and illustrated herein represent only some embodiments of the invention. It is appreciated by those skilled in the art that various changes and additions can be made to such products and materials without departing from the spirit and scope of this invention. It is intended that all such embodiments be covered by the appended claims.

What is claimed is:

1. A golf shoe, comprising:

a midsole and an outsole;

a lace tightening system comprising a lace and a lace tightening assembly; and an upper comprising:

a tongue member;

a power shroud overlying the tongue member, the power shroud comprising an inner layer and an outer layer with a window;

a composite support secured between the outer layer and the inner layer of the power shroud to stiffen the power shroud, wherein the composite support is configured to entirely fill the window; and a plurality of lace guides comprising a first upper lace guide; a second upper lace guide; a first lower lace guide; and a second lower lace guide, the first and second upper lace guides being attached to the power shroud and the first and second lower lace guides being attached to the upper, wherein the lace is configured to extend through the lace guides to form a loop between the power shroud and the first and second lower lace guides so that when the lace is tightened, the power shroud is secured along the upper.

2. The golf shoe of claim 1, wherein the composite support is secured between (i) the outer layer of the power shroud and (ii) the tongue member.

3. The golf shoe of claim 1, wherein the composite support is positioned over the tongue member so that the composite support covers the tongue member.

4. The golf shoe of claim 1, wherein the composite support is directly exposed through the window.

5. The golf shoe of claim 1, wherein the composite support is secured to a back surface of the power shroud.

6. The golf shoe of claim 1, wherein the composite support comprises a fiber-reinforced composite strip.

7. The golf shoe of claim 1, wherein the composite support is provided within the window.

8. The golf shoe of claim 1, wherein the outer layer of the power shroud comprises an additional window.

9. The golf shoe of claim 8, wherein the additional window is parallel to the window.

10. The golf shoe of claim 8, wherein the composite support is configured to fill and show through the additional window.

11. The golf shoe of claim 8, further comprising another composite support that is configured to show through the additional window.

12. The golf shoe of claim 1, wherein the lace tightening system is configured to pull the composite support across the tongue member and toward a lateral side of the upper when the lace is tightened via the lace tightening assembly.

13. The golf shoe of claim 1, wherein the lace tightening assembly is provided in a heel region of the golf shoe.

14. The golf shoe of claim 1, wherein the lace tightening assembly is provided on a medial or lateral side of the upper.

15. The golf shoe of claim 1, further comprising a skeletal frame extending upwardly from the midsole to provide additional stability and support to the golf shoe.

16. The golf shoe of claim 15, wherein the skeletal frame comprises an A-frame overlapping the upper.

17. The golf shoe of claim 16, wherein the A-frame comprises a hard and durable structure that works with the power shroud to stabilize the golf shoe.

18. The golf shoe of claim 16, wherein the A-frame comprises a unitary and integral structure with surfaces or segments that are joined together to define an aperture.

* * * * *